US010137380B2

(12) United States Patent
Choi

(10) Patent No.: US 10,137,380 B2
(45) **Date of Patent: *Nov. 27, 2018**

(54) TOP

(71) Applicant: Shin-Kyu Choi, Seoul (KR)

(72) Inventor: Shin-Kyu Choi, Seoul (KR)

(73) Assignee: Shin-Kyu Choi, Seoul (KR)

( * ) Notice: Subject to any disclaimer, the term of this patent is extended or adjusted under 35 U.S.C. 154(b) by 27 days.

This patent is subject to a terminal disclaimer.

(21) Appl. No.: 15/444,814

(22) Filed: Feb. 28, 2017

(65) Prior Publication Data

US 2017/0165584 A1 Jun. 15, 2017

Related U.S. Application Data

(63) Continuation of application No. 14/377,129, filed as application No. PCT/KR2013/003952 on May 7, 2013, now Pat. No. 9,616,351.

(30) Foreign Application Priority Data

May 8, 2012 (KR) ..... 10-2012-0048635
Dec. 31, 2012 (KR) ..... 10-2012-0157932
Jan. 10, 2013 (KR) ..... 10-2013-0003094

(51) Int. Cl.
*A63H 1/00* (2006.01)
*A63H 1/04* (2006.01)
*A63H 1/02* (2006.01)
*A63H 1/26* (2006.01)

(52) U.S. Cl.
CPC ..... *A63H 1/04* (2013.01); *A63H 1/02* (2013.01); *A63H 1/26* (2013.01)

(58) Field of Classification Search
CPC ..... A63H 1/00; A63H 1/30
See application file for complete search history.

(56) References Cited

U.S. PATENT DOCUMENTS 1,193,805 A 8/1916 Long
1,573,084 A 2/1926 Marx
1,806,485 A * 5/1931 Mirafuentes ..... A63H 1/28 446/251
1,866,697 A 7/1932 Blackburn
2,247,315 A 6/1941 Singer
2,619,931 A 12/1952 Mueller
(Continued)

FOREIGN PATENT DOCUMENTS

EP 0 077 438 A2 4/1983
KR 20-0405222 Y1 1/2006
(Continued)

OTHER PUBLICATIONS

International Search Report dated Aug. 27, 2013 in counterpart PCT Application No. PCT/KR2013/003952 (2 Pages in Korean, 2 Pages in English).

*Primary Examiner* — John E Simms, Jr.
*Assistant Examiner* — Urszula M Cegielnik
(74) *Attorney, Agent, or Firm* — NSIP Law

(57) ABSTRACT

The present invention relates to a top generating a clear collision sound when the top collides with another top so as to make playing with a top more exciting, and having an improved fastening structure for a metal wheel on the top so as to allow the metal wheel to sufficiently vibrate when the top collides.

2 Claims, 21 Drawing Sheets

(56) References Cited

U.S. PATENT DOCUMENTS

| | | | | |
|---|---|---|---|---|
| 2,788,612 | A | 4/1957 | Sametz | |
| 2,952,939 | A | 9/1960 | Limacher | |
| 3,233,359 | A | 2/1966 | Salayka | |
| 3,418,749 | A | 12/1968 | Ayala | |
| 3,701,216 | A | 10/1972 | Smith, III et al. | |
| 3,745,695 | A | 7/1973 | Thornell | |
| 3,939,603 | A | 2/1976 | Skinner | |
| 4,932,914 | A | 6/1990 | Aranda | |
| 4,938,483 | A | 7/1990 | Yavetz | |
| 6,083,076 | A | 7/2000 | Saint-Victor | |
| 6,626,729 | B2 | 9/2003 | Osawa | |
| 7,740,518 | B2 | 6/2010 | Elliott | |
| 8,764,509 | B1 | 7/2014 | Lytle | |
| 2002/0102907 | A1 | 8/2002 | Osawa | |
| 2006/0022403 | A1 | 2/2006 | Corrado | |
| 2006/0094329 | A1 | 5/2006 | Van Dan Elzen | |
| 2006/0156898 | A1 | 7/2006 | Nickel | |
| 2006/0211331 | A1* | 9/2006 | Trageser | A63H 29/24 446/429 |
| 2007/0021029 | A1 | 1/2007 | Weidetz et al. | |
| 2012/0094574 | A1* | 4/2012 | Grisolia | A63H 17/262 446/437 |
| 2015/0137453 | A1 | 5/2015 | Taylor | |

FOREIGN PATENT DOCUMENTS

| | | | |
|---|---|---|---|
| KR | 10-2010-0137171 | A | 12/2010 |
| KR | 10-2011-0010132 | U | 10/2011 |

* cited by examiner

TOP

CROSS-REFERENCE TO RELATED APPLICATIONS

This application is a continuation of U.S. patent application Ser. No. 14/377,129 filed on Aug. 6, 2014, is a U.S. national stage application of International Application No. PCT/KR2013/003952 filed on May 7, 2013, which claims the benefit of Korean Patent Application Nos. 10-2012-0048635, 10-2012-0157932, and 10-2013-0003094 filed on May 8, 2012, Dec. 31, 2012, and Jan. 10, 2013 respectively, in the Korean Intellectual Property Office, the entire disclosures of which are incorporated herein by reference for all purposes.

TECHNICAL FIELD

The present invention relates to a top, and more particularly, to a top which generates a clear collision sound when the top collides with another top so as to make playing with a top more exciting, and has an improved fastening structure for a metal wheel on the top so as to allow the metal wheel to sufficiently vibrate when the top collides.

BACKGROUND

A traditional top has a wooden conical body and a metal ball inserted into the bottom end of the conical body or a screw having a semi-circular head coupled thereto.

In case of the wooden top, however, many endeavors are needed for the machining of the body and the insertion of the ball into the body, and further, if external impacts are applied to the wooden top, the wooden top may be easily cracked or broken. Accordingly, there has been recently proposed a synthetic resin top which is made of plastic synthetic resin by means of injection molding to provide the easiness of the manufacturing and the improvement in durability, and further, a top having a metal wheel has been disclosed in Korean Patent Application No. 2009-55462 (entitled "toy top").

On the other hand, top-spinning games include a game wherein a top rapidly returns to a target area of 5 to 10 m and a game wherein tops collide to make the counterpart top fall down.

FIG. 1 is an exploded perspective view showing the structure of a conventional top. As shown in FIG. 1, the conventional top includes a rotary body 11, a rotary shaft fixed to the rotary body 11, a holder 13 disposed on the outside of the rotary shaft, a rotary tip 14 coupled to the holder 13, and a winder 16 having a rack gear 16*a* formed on one side thereof to provide a rotary force to the rotary body 11.

According to the conventional top, if the winder 16 pulls by a user's one hand in the state wherein the holder 13 is held by the other hand of the user, the rotary shaft engaged with the rack gear 16*a* rotates the rotary body 11. Thus, the top collides with another top to make the counterpart top fall down.

The conventional top is machined with wood or synthetic resin, and when the top has many collisions during the top-spinning games, it generates just dull collision sounds, which unfortunately makes the top-spinning games less exciting.

Disclosure

Accordingly, the present invention has been made in view of the above-mentioned problems occurring in the prior art, and it is an object of the present invention to provide a top which generates a clear collision sound when the top collides with another top so as to make playing with a top more exciting, and has an improved fastening structure for a metal wheel on the top so as to allow the metal wheel to sufficiently vibrate when the top collides.

DETAILED DESCRIPTION OF DRAWINGS

Hereinafter, an explanation on a top according to preferred embodiments of the present invention will be in detail given with reference to the attached drawing.

First Embodiment

Figure 2:
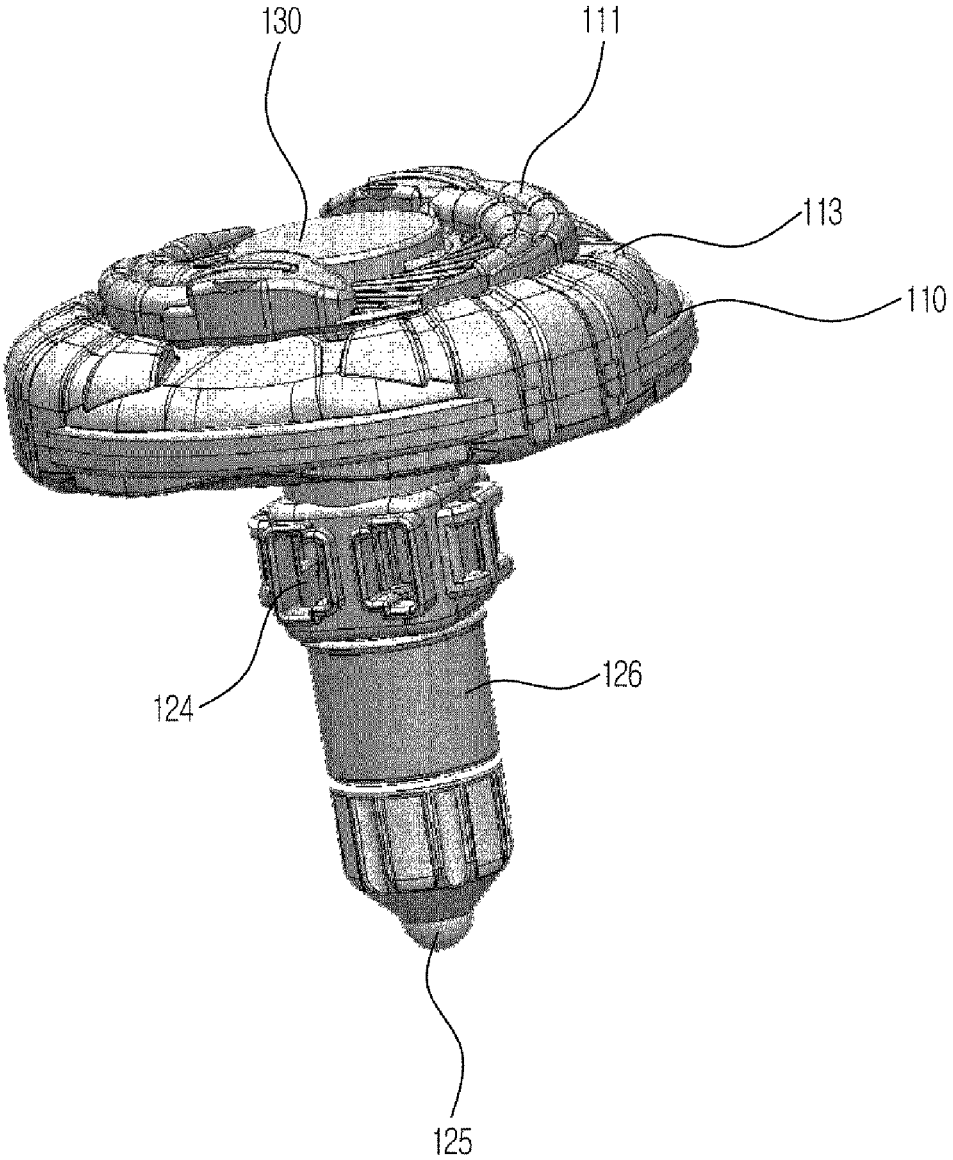
FIG. 2 is a perspective view showing a top according to a first embodiment of the present invention.
Figure 3:
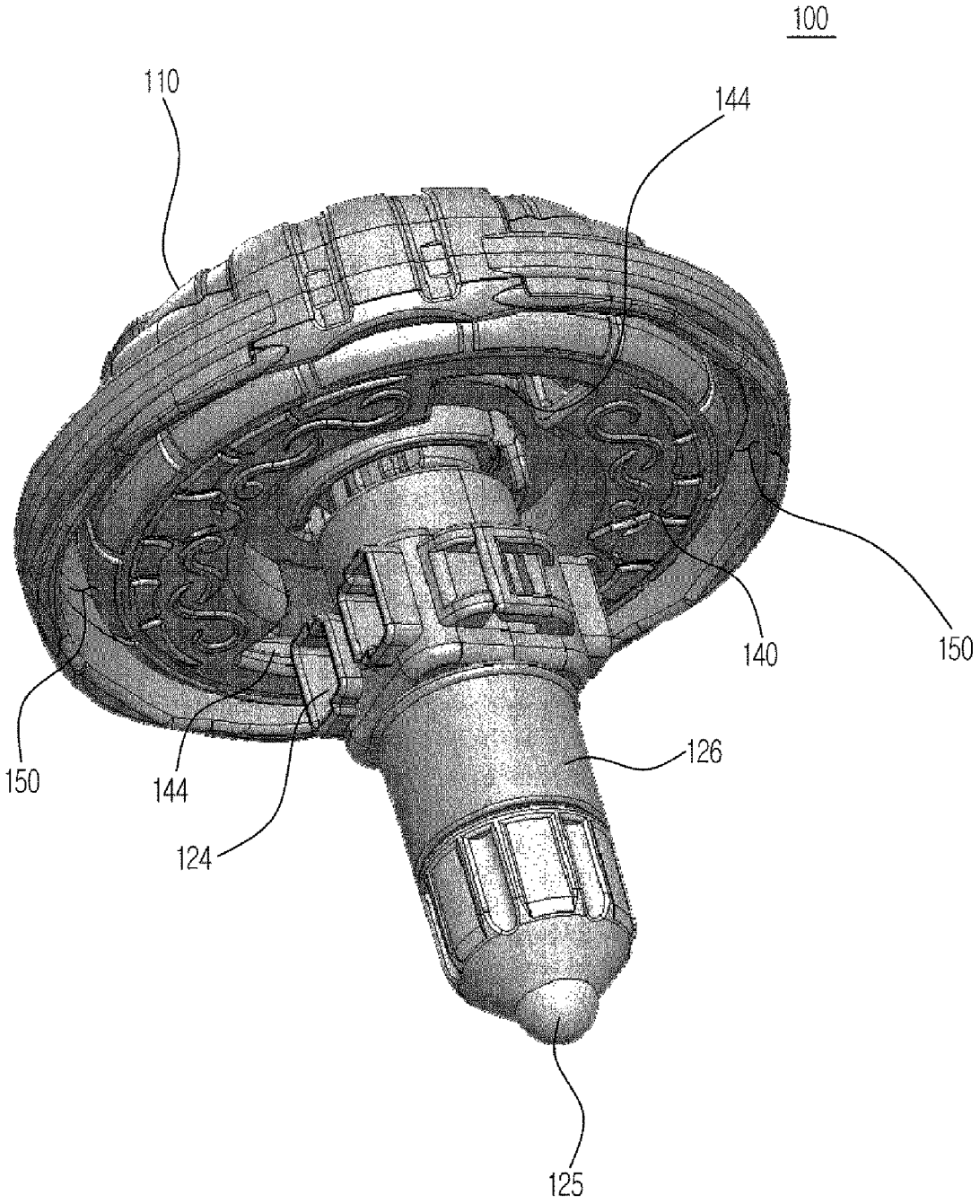
FIG. 3 is a bottom perspective view showing the top of FIG. 2.
Figure 4:
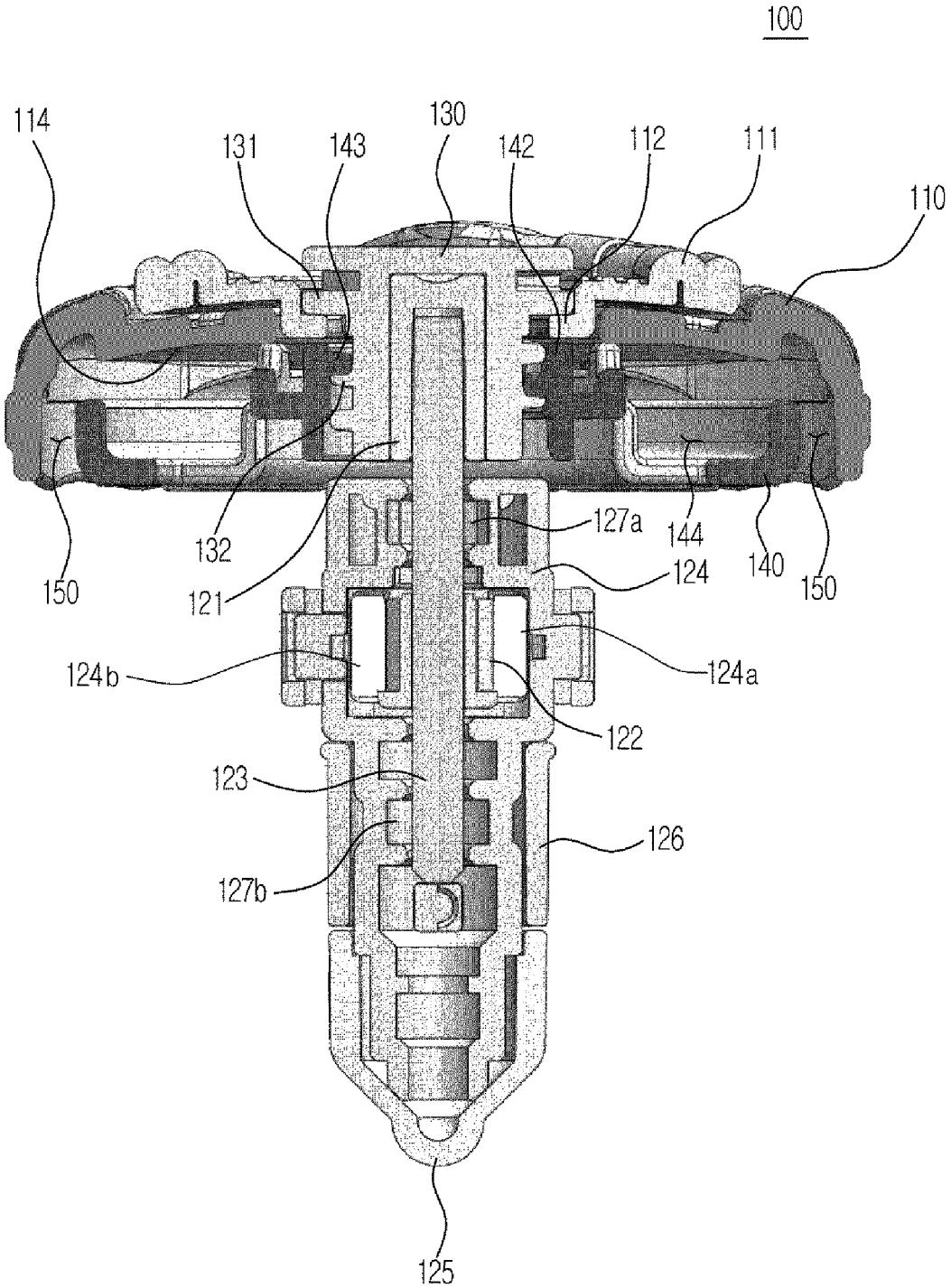
FIG. 4 is a sectional view showing the structure of the toy of FIG. 2.
Figure 5:
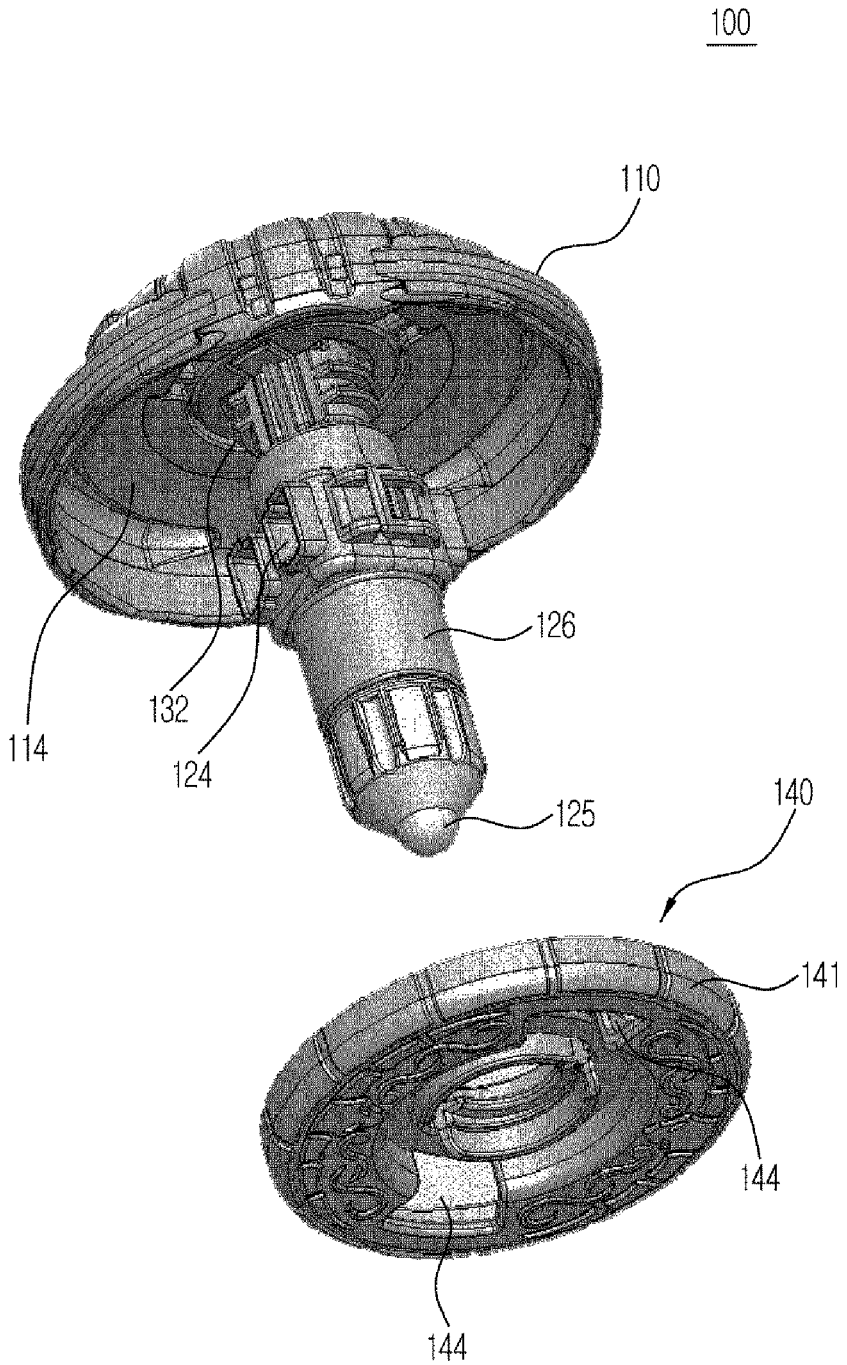
FIG. 5 is an exploded perspective view showing the structure of the toy of FIG. 2.
Figure 6:
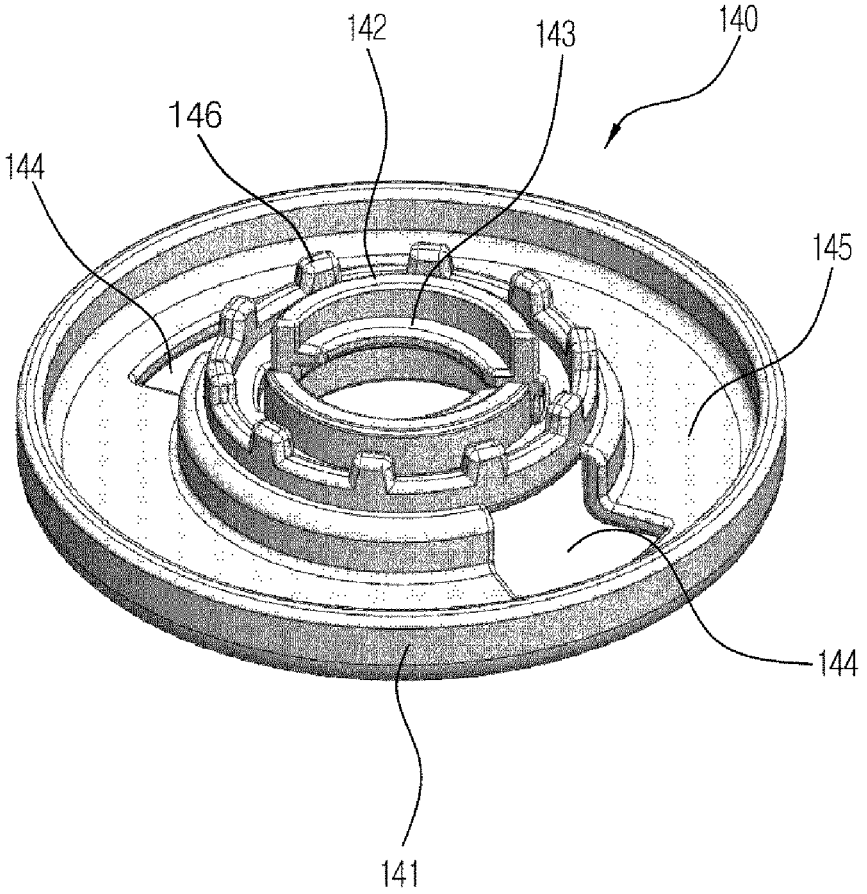
FIG. 6 is a perspective view showing an example of a resonating part of the top of FIG. 2.

FIG. 2 is a perspective view showing a top according to a first embodiment of the present invention, FIG. 3 is a bottom perspective view showing the top of FIG. 2, FIG. 4 is a sectional view showing the structure of the toy of FIG. 2, FIG. 5 is an exploded perspective view showing the structure of the toy of FIG. 2, and FIG. 6 is a perspective view showing an example of a resonating part of the top of FIG. 2.

As shown in FIGS. 2 to 6, a top 100 according to a first embodiment of the present invention includes a metal wheel 110 generating a clear collision sound therefrom when the top collides with another top, a rotary force generating part 120, a fixing part 130, and a resonating part 140.

The metal wheel 110 has a vibration space formed at the inside thereof to generate a collision sound when the top collides with another top and has a shape of a bell which has a through hole formed at the center thereof and open on the disc-shaped lower portion thereof.

Further, the metal wheel 110 is made of zinc or an alloy containing zinc and otherwise, it is made of brass or an alloy containing brass.

Furthermore, the metal wheel 110 is formed to sufficiently maintain the vibration when the top collides, and a design wheel 111 made of plastic material is mounted on the top portion of the metal wheel 110 so as to improve the outer appearance of the top 100.

The design wheel 111 has a locking projection 112 coupled to the fixing part 130 so as to stably fix the metal wheel 110 thereto, and the design wheel 111 serves as a damper between the metal wheel 110 and the rotary force generating part 120 to sufficiently maintain the resonance (vibration) generated from the metal wheel 110.

Additionally, the metal wheel 110 has at least one collision protrusion 113 formed on the outer peripheral surface thereof and a wheel resonance cavity portion 114 formed at the inside thereof to increase the collision sound having a specific frequency component generated from the metal material constituting the metal wheel 110 through resonance if the collision occurs.

The wheel resonance cavity portion 114 is curvedly formed to allow the collision sound generated by the collision to be resonated at the inside thereof, thus providing sufficient resonance space therein.

The rotary force generating part 120 generates a rotary force to rotate the metal wheel 110 and includes a bush 121, a pinion gear 122, a shaft 123, a gear housing 124, a bottom portion 125, a handle portion 126, and upper and lower bearings 127*a* and 127*b*.

The bush 121 is inserted into the fixing part 130 to prevent the shaft 123 from idling when the shaft 123 is coupled to the fixing part 130.

Figure 1:
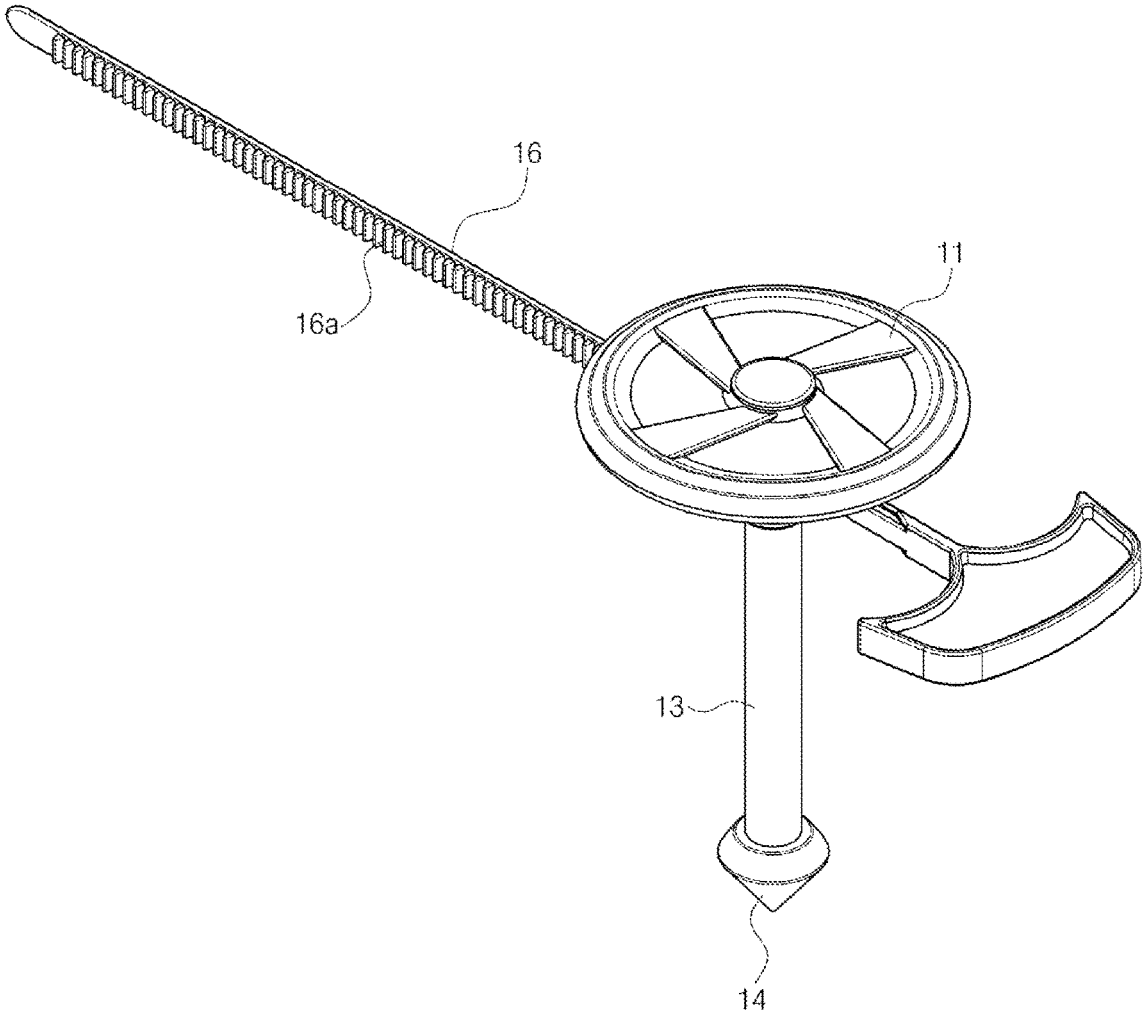
FIG. 1 is an exploded perspective view showing the structure of a conventional top.

The pinion gear 122 rotates by means of the winder 16 (See FIG. 1) having the rack gear 16*a* (See FIG. 1) formed on one side surface thereof, thus rotating the shaft 123.

The gear housing 124 has first and second entrances 124*a* and 124*b* formed thereon, through which the rack gear 16*a* of the winder 16 is passed, and the first and second entrances 124*a* and 124*b* are open at the different positions from each other, so that the top 100 is rotated selectively in clockwise and counterclockwise directions through the rotary force generating part 120.

The bottom portion 125 has the front end portion rotating while coming into contact with the ground, and the front end portion may have various shapes like cone, sphere and so on.

The handle portion 126 serves to connect the gear housing 124 and the bottom portion 125, and when a rotary force is applied to the top 100, the handle portion 126 is held by a user's hand.

The upper and lower bearings 127*a* and 127*b* are coupled to both sides of the shaft 123 to gently rotate the shaft 123.

The fixing part 130 has a shape of a cylinder supporting the metal wheel 110 to allow the metal wheel 110 to be fixedly brought into close contact with the rotary force generating part 120, and the fixing part 130 has a first flange 131 formed radially on the outer peripheral surface thereof in such a manner as to be engaged with the locking projection 112 of the design wheel 111 so as to allow the design wheel 111 to be fixed to the top end periphery of the metal wheel 110 and a second flange 132 engaged with a fastening portion flange 143 of the resonating part 140 to allow the metal wheel 110 to be coupled to the resonating part 140.

The resonating part 140 is disposed under the metal wheel 110 to allow the collision sound generated from the metal wheel 110 when the top 100 collides to be resonated, thus making the collision sound become louder and outputted for a long period of time. The resonating part 140 includes a body 141, a fastening portion 142, emission holes 144, a resonance cavity portion 145, and a flange 146.

The body 141 has a shape of a cup which is open on the top surface thereof and has a through hole formed at the center thereof, and the rotary force generating part 120 is inserted into the through hole.

The fastening portion 142 protrudes upward by a given length from the through hole of the body 141 and has the fastening portion flange 143 formed on the inner peripheral surface thereof in such a manner as to be coupled to the second flange 132 of the fixing part 130, thus allowing the metal wheel 110 to be coupled to the resonating part 140.

At least one or more emission holes 144 are punched on the resonance cavity portion 145 of the body 141 to emit the collision sound resonated in the resonating part 140 to the outside of the resonating part 140.

Figure 7:
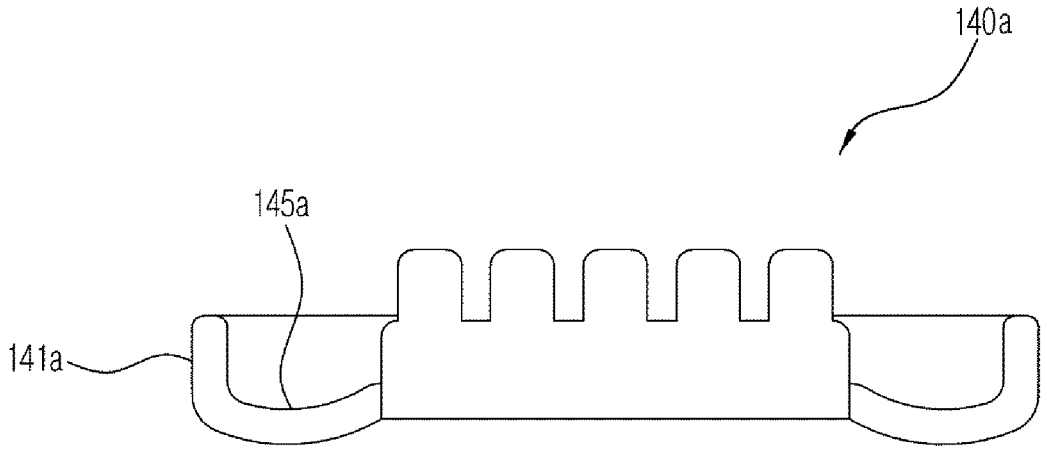
FIG. 7 is a sectional view showing another example of the resonating part of the top of FIG. 2.

The resonance cavity portion 145 is formed on the bottom surface of the body 141 to increase the collision sound having a specific frequency through resonance, which provides a resonance space in which the collision sound of the metal wheel 110 generated when the top 100 bumps against the interior thereof and becomes resonated. The resonance cavity portion 145 has a flat surface, and otherwise, as shown in FIG. 7, a resonating part 140*a* may be provided to have a concave resonance cavity portion 145*a*.

That is, the resonating part 140*a* has the concave resonance cavity portion 145*a* formed on the bottom surface of a body 141*a*, which provides a resonance space in which the collision sound effectively bumps against the interior of the resonance cavity portion 145*a* and is thus resonated.

Referring again to FIGS. 2 to 6, the flange 146 protrudes upward by a given length from the body 141 so as to allow the resonating part 140 to be spaced apart from the underside of the metal wheel 110 by a given distance, thus preventing the metal wheel 110 and the resonating part 140 from being completely brought into close contact with each other to form a sufficient resonance space between the wheel resonance cavity portion 114 and the resonance cavity portion 145.

On the other hand, the outer diameter of the resonating part 140 is smaller than the inner diameter of the metal wheel 110 to form a gap 150 between the metal wheel 110 and the resonating part 140, so that the collision sound generated from the metal wheel 110 is rapidly outputted to the outside of the top 100, and the collision sound resonated between the wheel resonance cavity portion 114 and the resonance cavity portion 145 of the resonating part 140 is sequentially outputted according to the amplitude thereof, thus being continuously outputted.

Accordingly, the top 100 forms the resonance space formed at the inside thereof to generate the clear collision sound when it collides and to keep the generated collision sound for a given period of time, thus stimulating the user's acoustic sense to make the playing with the top 100 more exciting.

Figure 8:
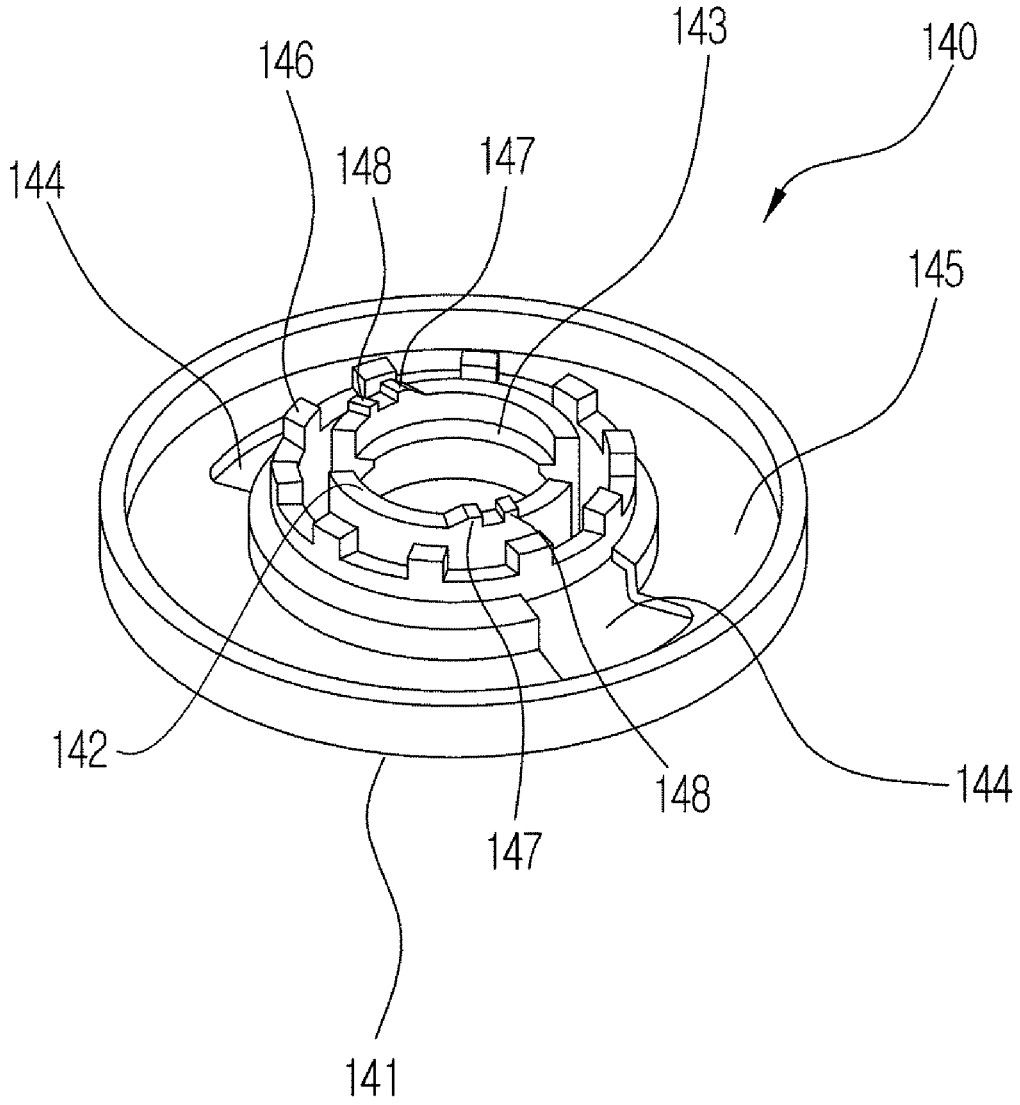
FIG. 8 is a perspective view showing still another example of the resonating part of the top of FIG. 2.
Figure 9:
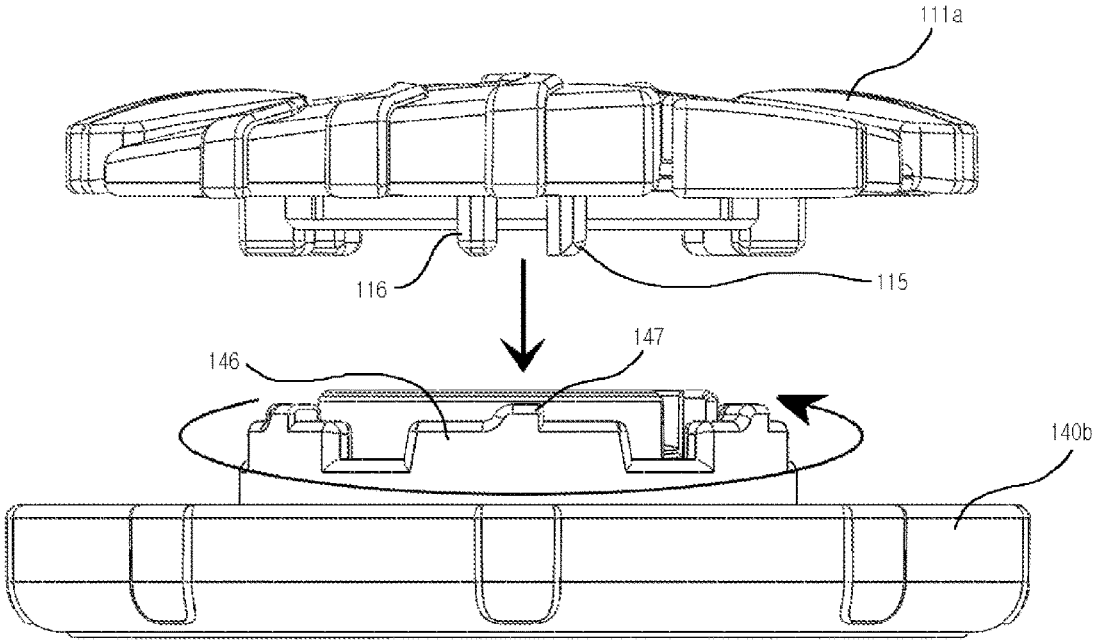
FIG. 9 is a side view showing the coupling process of the resonating part and a design wheel of FIG. 8.
Figure 10:
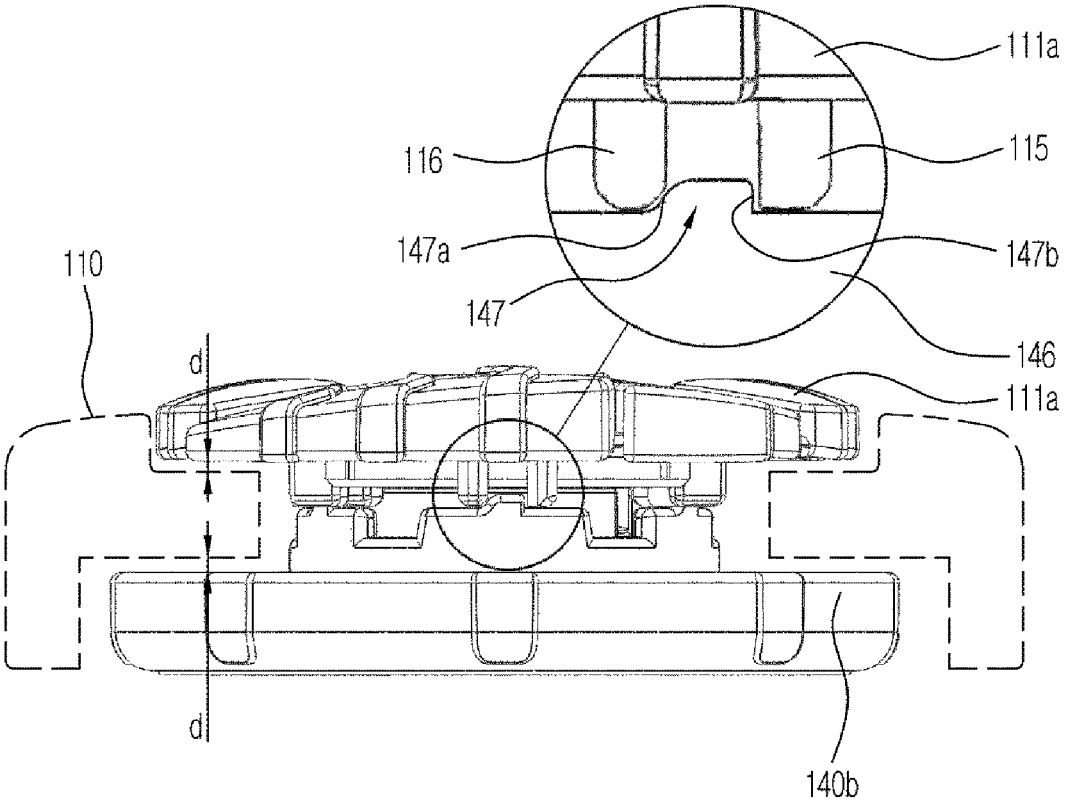
FIG. 10 is a side view showing the state wherein the resonating part and the design wheel of FIG. 8 have been coupled to each other.

FIG. 8 is a perspective view showing still another example of the resonating part of the top of FIG. 2, FIG. 9 is a side view showing the coupling process of the resonating part and a design wheel of FIG. 8, and FIG. 10 is a side view showing the state wherein the resonating part and the design wheel of FIG. 8 have been coupled to each other.

As shown in FIGS. 8 to 10, the top 100 according to the first embodiment of the present invention includes the metal wheel 110 generating a clear collision sound when the top collides with another top, a design wheel 111*a*, the rotary force generating part 120, the fixing part 130, and a resonating part 140*b*.

The repeated explanation on the metal wheel 110, the rotary force generating part 120, and the fixing part 130 will be avoided, and only the design wheel 111*a* and the resonating part 140*b* which are different from those in the top 100 will be described.

The design wheel 111*a* is mounted on the top portion of the metal wheel 110 so as to improve the outer appearance of the top 100 and is adapted to form a gap d by which the metal wheel 110 is not brought into close contact with the resonating part 140*b* to allow the metal wheel 110 to sufficiently vibrate when the top 100 collides. The design wheel 111*a* includes a locking projections 112, first stoppers 115, and second stoppers 116.

The locking projection 112 is engaged with the fixing part 130 to fix the metal wheel 110 to the fixing part 130.

The first stoppers 115 protrude downward by a given length from the underside of the design wheel 111*a* and are engaged with the resonating part 140*b* to prevent the design wheel 111*a* from rotating over a given range.

In the process of coupling the metal wheel 110 to the resonating part 140*b*, that is, the first stoppers 115 are engaged with the resonating part 140*b* to prevent the design wheel 111*a* rotating together with the fixing part 130 and pressurizing the metal wheel 110 from rotating over a given range, so that the design wheel 111*a* does not rotate anymore for the fixation thereof by means of a user, and thus, the metal wheel 110 is not completely fixed to the space between the design wheel 111*a* and the resonating part 140*b*, thus forming the gap d.

The second stoppers 116 are spaced apart from the first stoppers 115 by a given distance and protrude downward by a given length from the underside of the design wheel 111*a* to prevent the design wheel 111*a* from rotating in the opposite direction to the rotating direction thereof, thus keeping the design wheel 111*a* from being loose.

That is, the rotation in the opposite direction to the rotating direction of the design wheel 111*a* fixed by the first stoppers 115 is prevented by means of the second stoppers 116, so that the design wheel 111*a* does not rotate anymore, and thus, the metal wheel 110 is not completely fixed to the space between the design wheel 111*a* and the resonating part 140*b*, thus forming the gap d.

The resonating part 140*b* is located under the metal wheel 110 to resonate the collision sound generated from the metal wheel 110 when the top 100 collides, thus making the collision sound become louder and outputted for a long period of time. The resonating part 140*b* includes a body 141, a fastening portion 142, emission holes 144, a resonance cavity portion 145, flanges 146, and stoppers 147.

The stoppers 147 protrude upward by a given length from the top surfaces of the flanges 146 and are engaged with the design wheel 111*a* to prevent the design wheel 111*a* from rotating over a given range, and each stopper 147 has an inclined portion 147*a* formed on one side thereof to have a given inclination so as to allow the first stopper 115 to easily move thereover in the rotating direction thereof and a bent stepped portion 147*b* formed on the other side thereof to prevent the first stopper 115 from moving thereover in the opposite direction to the rotating direction thereof.

That is, the movement of the first stopper 115 over the inclined portion 147*a* can be recognized by the user, and the stepped portion 147*b* serves to prevent the first stopper 115 moving over the inclined portion 147*a* from moving in the opposite direction to the moved direction.

If the metal wheel 110 is fixedly completely brought into close contact with the resonating part 140*b* in the process wherein the design wheel 111*a* rotates by the fixing part 130 to allow the metal wheel 110 to come into close contact with the resonating part 140*b*, the vibration space of the metal wheel 110 is not sufficiently ensured, thus failing to sufficiently generate the collision sound. Accordingly, the formation of the first stoppers 115 and the second stoppers 116 of the design wheel 111*a* and the stoppers 147 of the resonating part 140*b* provides the given gaps d in the space between the design wheel 111*a* and the resonating part 140*b*, thus allowing the vibration of the metal wheel 110 to be sufficiently generated.

Second Embodiment

Figure 11:
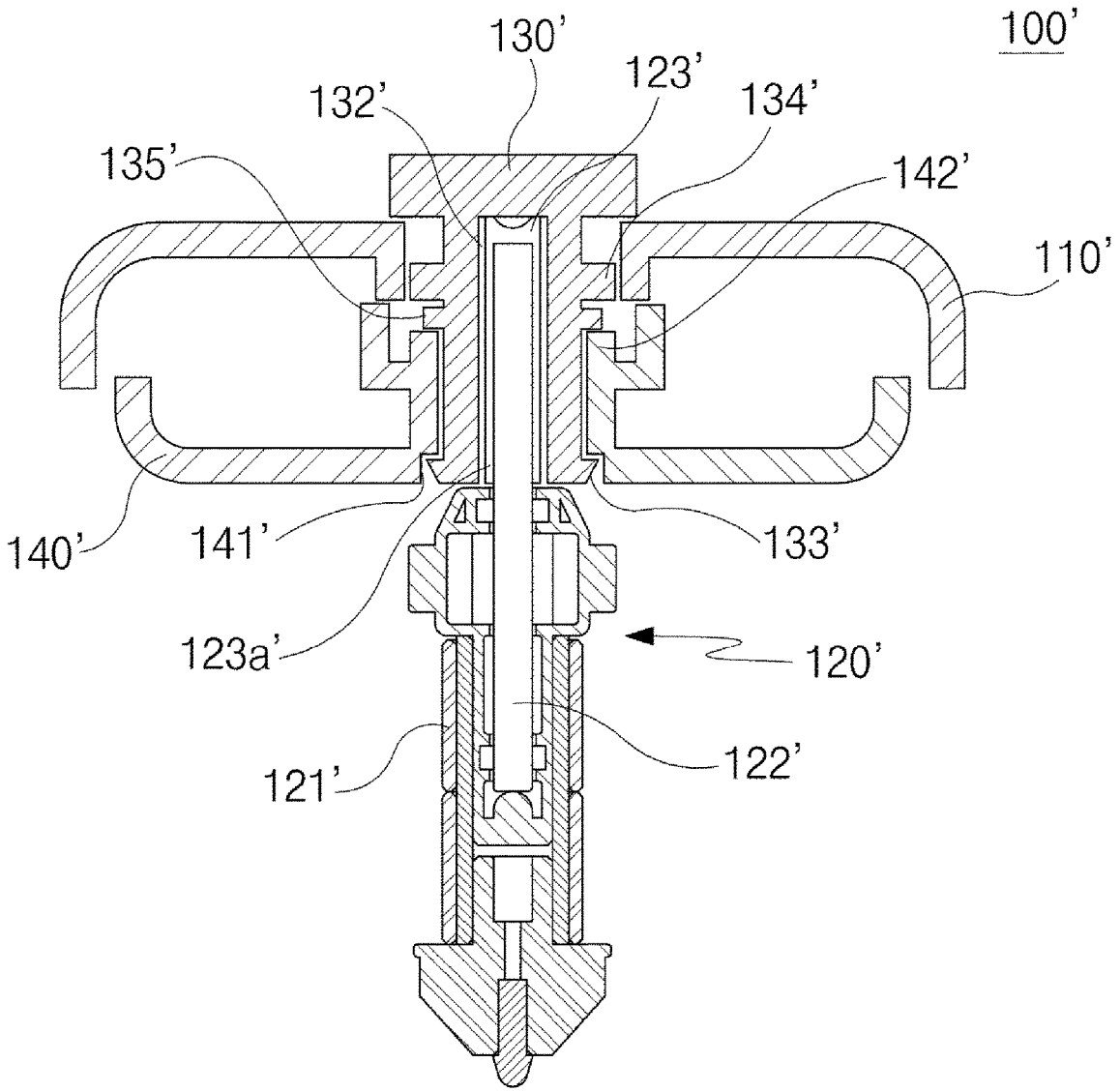
FIG. 11 is an exploded perspective view showing a top according to a second embodiment of the present invention.
Figure 12:
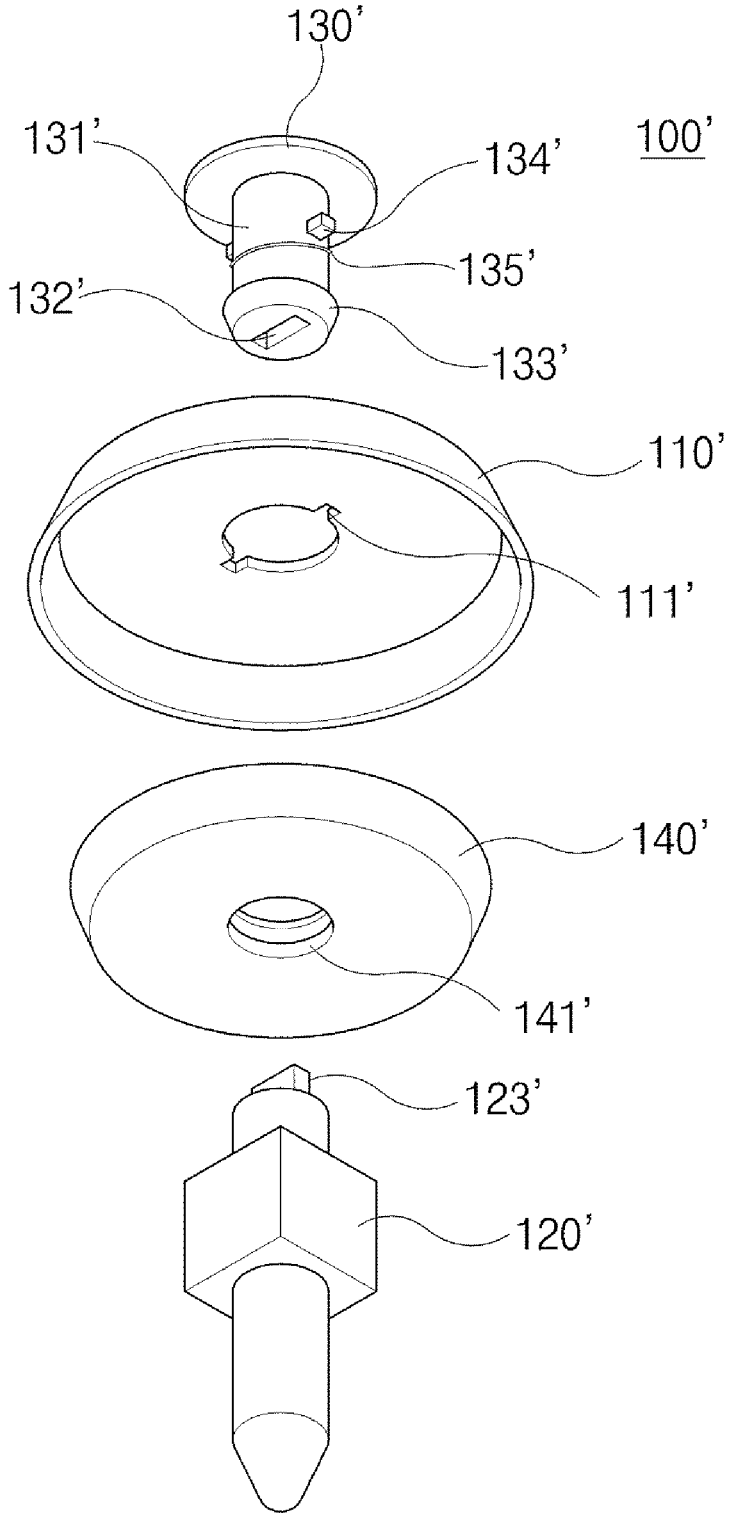
FIG. 12 is a sectional view showing the structure of the toy of FIG. 11.

FIG. 11 is an exploded perspective view showing a top according to a second embodiment of the present invention, and FIG. 12 is a sectional view showing the structure of the toy of FIG. 11.

As shown in FIGS. 11 and 12, a top 100' according to the second embodiment of the present invention includes a metal wheel 110', a rotary force generating part 120', a resonating part 140', and a fixing part 130' coupled to the rotary force generating part 120' in such a manner as to form a gap in which the metal wheel 110' vibrates up and down.

The metal wheel 110' is a metal member having a shape of a disc or a bell which is open on the lower portion thereof and curved at the inside thereof, and the metal wheel 110' includes a through hole formed at the center thereof and at least one or more fastening portions 111' formed concaved radially on the inner periphery of the through hole in such a manner as to be symmetrically located around the through hole.

The rotary force generating part 120' is disposed under the metal wheel 110' and coupled to the metal wheel 110' by means of the fixing part 130', thus supporting the metal wheel 110' and at the same time generating a rotary force therefrom to rotate the metal wheel 110'. The rotary force generating part 120' includes a body 121', a rotary shaft 122' rotatably disposed inside the body 121', and a bush 123' disposed on the top end of the rotary shaft 122' to prevent the shaft 122' from idling.

The bush 123' is coupled to the rotary shaft 122' through an insertion groove 123*a'* and inserted into a coupling groove 132' of the fixing part 130' to transmit the rotary force of the rotary shaft 122' to the metal wheel 110' through the fixing part 130'.

The fixing part 130' is passed through the metal wheel 110' and the resonating part 140' and coupled to the rotary force generating part 120', which serves to fix the metal wheel 110' to the rotary force generating part 120'. The fixing part 130' includes a body 131', the coupling groove 132', a locking projection 133', fastening protrusions 134', and a protrusion 135'.

The body 131' has a disc-shaped or polygonal flange formed at one side thereof and a cylindrical member formed at the other side thereof, and the length of the body 131' of the fixing part 130' is longer than the length of the laminated metal wheel 110' and the resonating part 140', thus allowing the metal wheel 110' to be movable.

The coupling groove 132' is formed on the underside of the body 131' extended to one side of the fixing part 130', into which the bush 123' of the rotary force generating part 120' is fixedly inserted.

The locking projection 133' protrudes in a shape of a wedge from the opposite end to one end of the body 131' having the flange. The locking protrusion 133' is fitted to the through hole of the metal wheel 110', and otherwise, it is passed through the through hole of the metal wheel 110', press fitted to the through hole of the resonating part 140', and finally coupled to a fastening groove 141' of the resonating part 140', thus allowing the metal wheel 110' or the metal wheel 110' and the resonating part 140' to be mounted between the flange of the body 131' and the locking projection 133' of the fixing part 130' to form a gap between the metal wheel 110' and the resonating part 140' in which the metal wheel 110' is movably coupled to the fixing part 130' and the resonating part 140'.

The fastening protrusions 134' protrude outward radially by a given length from arbitrary positions of the outer peripheral surface of the body 131' in such a manner as to be engaged with the fastening portions 111' of the metal wheel 110' to transmit the rotary force received from the fixing part 130' to the metal wheel 110', thus allowing the fixing part 130' and the metal wheel 110' to rotate together.

The protrusion 135' is formed in a shape of a ring along the outer peripheral surface of the body 131' and passed through the through hole of the metal wheel 110' by means of press-fitting to allow the metal wheel 110' to have the gap between the flange of the fixing part 130' and the locking projection 133'.

That is, if only the metal wheel 110' is fixed, the protrusion 135' forms the gap between the flange of the fixing part 130' and the locking projection 133' to allow the metal wheel 110' to be movable thereinto, and further, if the resonating part 140' is mounted under the metal wheel 110', the protrusion 135' forms the gap between the metal wheel 110' and the resonating part 140' to allow the metal wheel 110' to movable thereinto, while being not completely brought into close contact with the fixing part 130' and the resonating part 140'.

The resonating part 140' is disposed between the metal wheel 110' and the rotary force generating part 120' to allow the collision sound generated from the metal wheel 110' when the top 100' collides to be resonated and outputted. The resonating part 140' has a shape of a cup which is open on the top surface thereof and has a through hole formed at the center thereof and the fastening groove 141' formed on the lower end periphery of the through hole, and the rotary force generating part 120' is inserted into the through hole.

Third Embodiment

Figure 13:
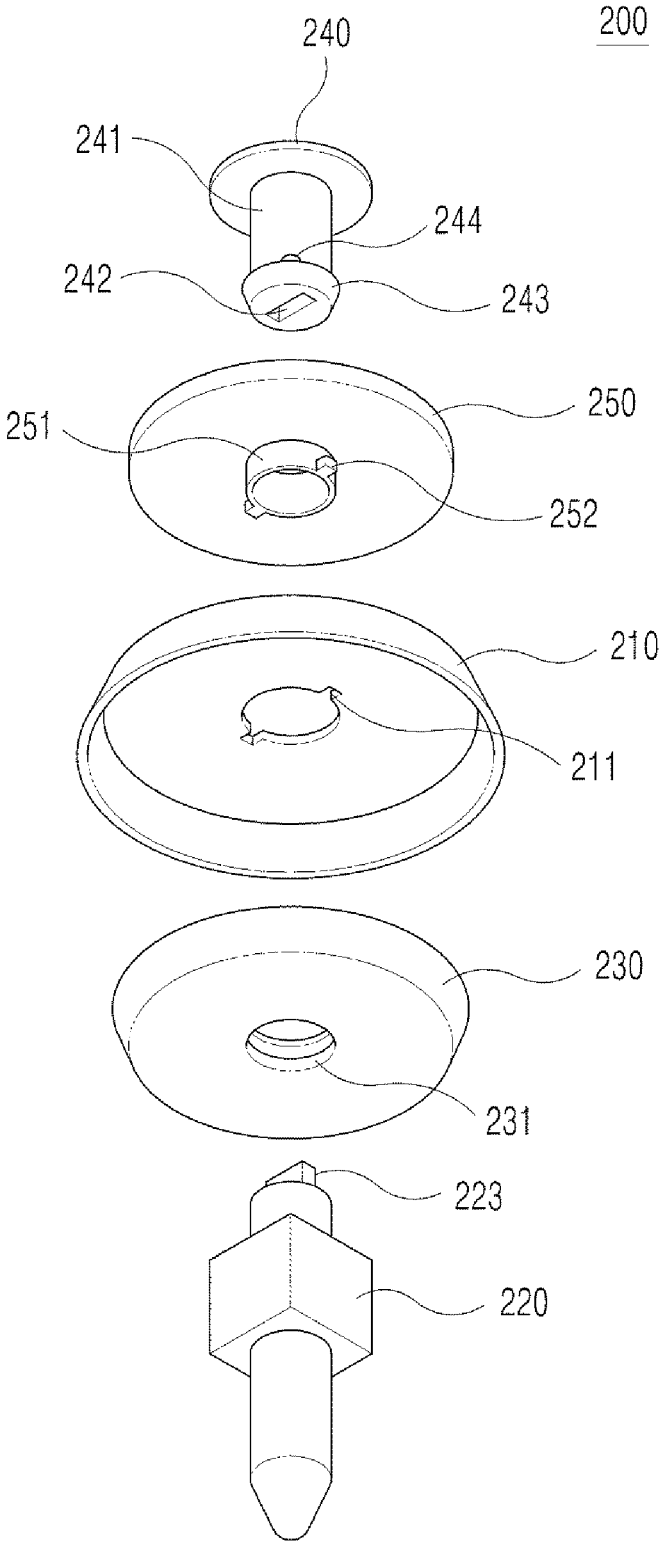
FIG. 13 is an exploded perspective view showing a top according to a third embodiment of the present invention.
Figure 14:
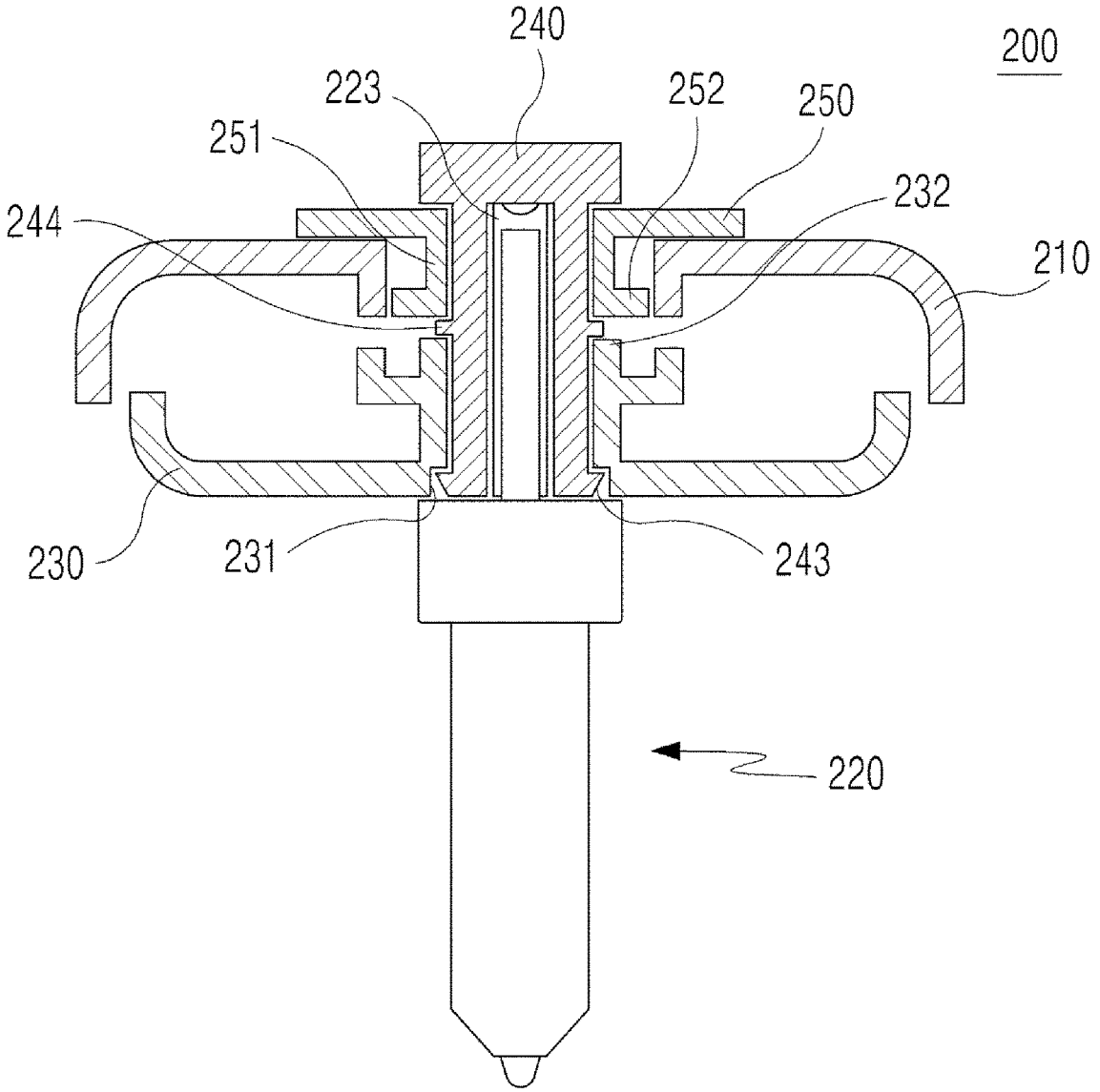
FIG. 14 is a sectional view showing the structure of the toy of FIG. 13.

FIG. 13 is an exploded perspective view showing a top according to a third embodiment of the present invention, and FIG. 14 is a sectional view showing the structure of the toy of FIG. 13.

As shown in FIGS. 13 and 14, a top 200 according to the third embodiment of the present invention includes a metal wheel 210 having a through hole formed at the center thereof, a rotary force generating part 220 disposed under the metal wheel 210 to support and rotate the metal wheel 210, a fixing part 240 passed through the metal wheel 210 and coupled to the rotary force generating part 220 to fix the metal wheel 210 to the rotary force generating part 220, and a design wheel 250 disposed on the top portion of the metal wheel 210 to improve the outer appearance of the top 200.

The metal wheel 210 is a metal member having a shape of a disc or a bell which is open on the lower portion thereof and curved at the inside thereof, and the metal wheel 210 includes a through hole formed at the center thereof and at least one or more fastening portions 211 formed concaved radially on the inner periphery of the through hole in such a manner as to be symmetrically located around the through hole.

The rotary force generating part 220 is disposed under the metal wheel 210 and coupled to the metal wheel 210, a resonating part 230 and the design wheel 250 by means of the fixing part 230, thus supporting the metal wheel 210, the resonating part 230 and the design wheel 250 thereagainst.

The resonating part 230 is disposed between the metal wheel 210 and the rotary force generating part 220 to allow the collision sound generated from the metal wheel 210 when the top 200 collides to be resonated and outputted. The resonating part 230 has a shape of a cup which is open on the top surface thereof and has a through hole formed at the center thereof, a fastening groove 231 formed on the lower end periphery of the through hole, and a fastening protrusion 232 extended by a given length from the top end periphery of the through hole.

The fixing part 240 is passed through the metal wheel 210, the resonating part 230 and the design wheel 250 and coupled to the rotary force generating part 220, which serves to fix the metal wheel 210 to the rotary force generating part 220. The fixing part 240 includes a body 241, a coupling groove 242, a locking projection 243, and protrusions 244.

The body 241 has a disc-shaped or polygonal flange formed on one side thereof and a cylindrical member formed on the other side thereof, and the length of the body 241 of the fixing part 240 is longer than the length of the metal wheel 210, the resonating part 230 and the design wheel 250 laminated to each other, thus allowing the metal wheel 210 to be movable.

The coupling groove 242 is formed on the underside of the body 241 extended to one side of the fixing part 240, into which a bush 223 of the rotary force generating part 220 is fixedly inserted.

The locking projection 243 protrudes in a shape of a wedge from the opposite end to one end of the body 241 having the flange to allow the design wheel 250 and the metal wheel 210 or the design wheel 250, the metal wheel 210 and the resonating part 230 to be mounted between the flange of the body 241 and the locking projection 243.

That is, the locking projection 243 is fitted to the through hole of the metal wheel 210 to allow the design wheel 250 and the metal wheel 210 to be mounted between the flange of the body 241 and the locking projection 243, and otherwise, the locking projection 243 is passed through the design wheel 250 and the metal wheel 210 and fitted to the fastening groove 231 of the resonating part 230 to allow the design wheel 250, the metal wheel 210 and the resonating part 230 to be coupled and mounted between the flange of the body 241 and the locking projection 243.

The protrusions 244 protrude outward by a given length radially from arbitrary positions of the outer peripheral surface of the body 241 and are press-fitted to the through hole of the design wheel 250 to form a gap between the design wheel 250 and the locking protrusion 243. Further, if the resonating part 230 is mounted under the metal wheel 210, the protrusions 244 form the gap between the fastening protrusion 232 of the resonating part 230 and the design wheel 250 to allow the metal wheel 210 to movable thereinto, while being not completely brought into close contact with the resonating part 230 and the design wheel 250, so that if the top 200 collides, the metal wheel 210 is movable to allow the vibration generated therefrom to be sufficiently maintained.

The design wheel 250 has an insertion portion 251 protruding downward by a given length from the through hole punched on the center thereof in such a manner as to be inserted into the through hole of the metal wheel 210 and fastening protrusions 252 protruding outward by a given length radially from the outer peripheral surface of the insertion portion 251 in such a manner as to be engaged with the fastening portions 211 of the metal wheel 210.

Accordingly, the fixing part 240 is configured to fix the design wheel 250, the metal wheel 210 and the resonating part 230 thereto in the state wherein they are not completely brought into close contact with each other, so that if collision occurs on the metal wheel 210, the metal wheel 210 can be moved in up and down directions of the fixing part 240, thus allowing the vibration of the metal wheel 210 to be sufficiently maintained.

Fourth Embodiment

Figure 15:
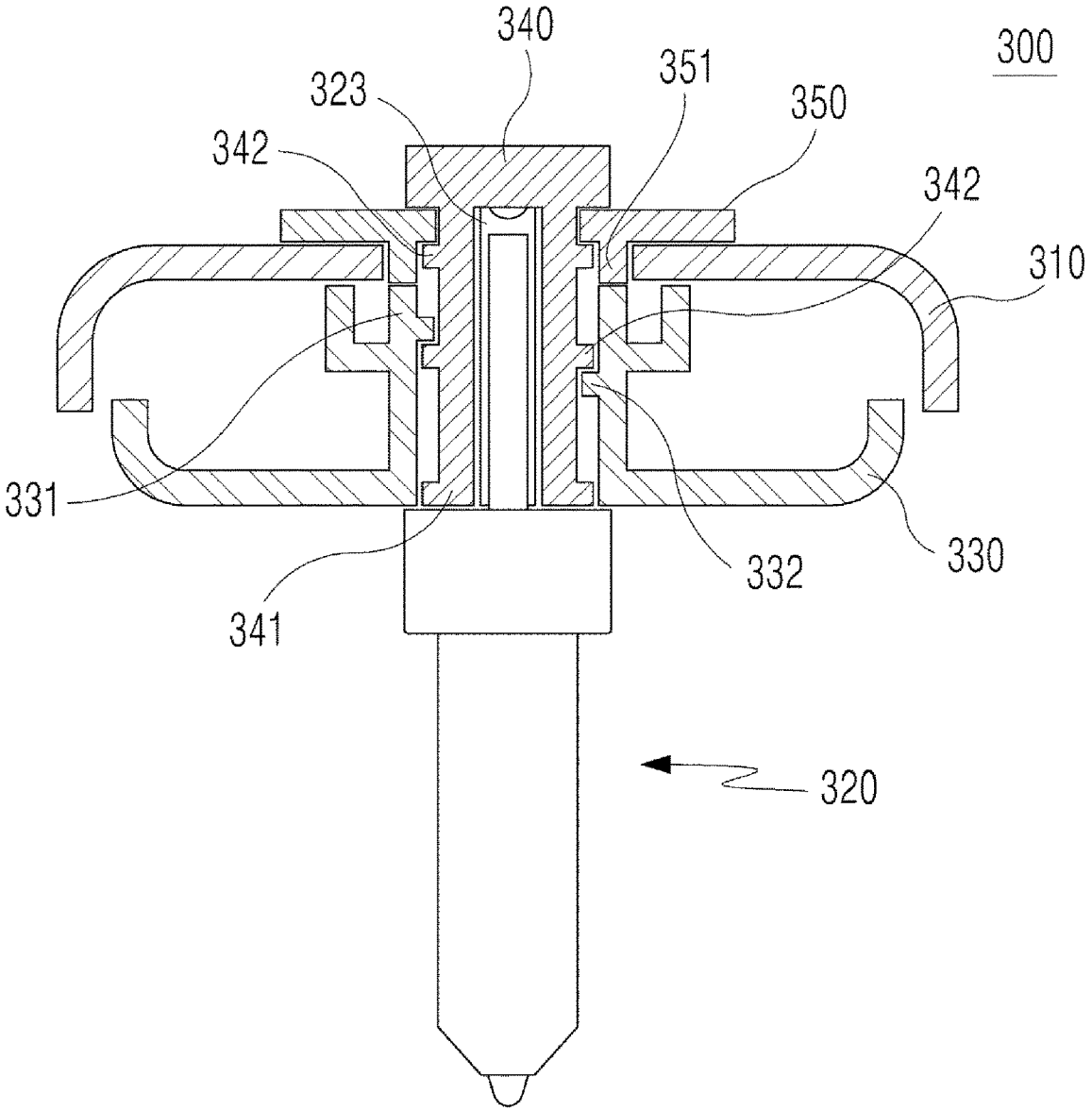
FIG. 15 is a sectional view showing a top according to a fourth embodiment of the present invention.

FIG. 15 is a sectional view showing a top according to a fourth embodiment of the present invention.

As shown in FIG. 15, a top 300 according to the fourth embodiment of the present invention includes a metal wheel 310 having a through hole formed at the center thereof, a rotary force generating part 320 disposed under the metal wheel 310 to support and rotate the metal wheel 310, a fixing part 340 passed through the metal wheel 310 and coupled to the rotary force generating part 320 to fix the metal wheel 310 to the rotary force generating part 320, and a design wheel 350 disposed on the top portion of the metal wheel 310 to improve the outer appearance of the top 300.

The metal wheel 310 is a metal member having a shape of a disc or a bell which is open on the lower portion thereof and curved at the inside thereof, and the metal wheel 210 includes a through hole formed at the center thereof and at least one or more fastening portions formed concaved radially on the inner periphery of the through hole in such a manner as to be symmetrically located around the through hole.

The rotary force generating part 320 is disposed under the metal wheel 310 and coupled to the metal wheel 310, a resonating part 330 and the design wheel 350 by means of the fixing part 340, thus supporting the metal wheel 310, the resonating part 330 and the design wheel 350 thereagainst.

The resonating part 330 is disposed between the metal wheel 310 and the rotary force generating part 320 to allow the collision sound generated from the metal wheel 310 when the top 300 collides to be resonated and outputted. The resonating part 330 has a shape of a cup which is open on the top surface thereof and has a through hole formed at the center thereof, into which the rotary force generating part 320 is inserted.

Further, the resonating part 330 has a cup-shaped body which is open on the top portion thereof and has a through hole formed at the center thereof, a protrusion 331 protruding upward by a given length from the through hole thereof, and a fastening protrusion 332 formed on the inner periphery of the protrusion 331 in such a manner as to be engaged with the fixing part 340.

The fixing part 340 is passed through the design wheel 350, the metal wheel 310 and the resonating part 330 sequentially and coupled to the rotary force generating part 320. The fixing part 340 is coupled to the design wheel 350 and the resonating part 330 to allow the metal wheel 310 to be movable between the resonating part 330 and the design wheel 350. The fixing part 340 has a cylindrical body having a disc-shaped or polygonal flange formed on one side thereof and a coupling groove 341 formed on the other side thereof to insert a bush 323 of the rotary force generating part 320 thereinto. Further, the fixing part 340 has fastening protrusions 342 formed on the outer peripheral surface thereof in such a manner as to be engaged correspondingly with the resonating part 330 and the design wheel 350.

The design wheel 350 is disposed on the top portion of the metal wheel 310 to improve the outer appearance of the top 300 and has a through hole formed on the center thereof and a protrusion 351 protruding downward by a given length from the through hole thereof, so that even if the protrusion 351 comes into close contact with the resonating part 330, the resonating part 330 and the design wheel 350 are spaced apart from each other.

That is, the length formed by the contact between the protrusion 331 of the resonating part 330 and the protrusion 351 of the design wheel 350 is longer than the thickness of the metal wheel 310, so that even if the design wheel 350 and the resonating part 330 come into close contact with each other by means of the pressurization of the fixing part 340, the space in which the metal wheel 310 can be moved is provided.

Accordingly, even though the design wheel 350 and the resonating part 330 are completely brought into close contact with each other by means of the fixing part 340, the space in which the metal wheel 310 can be moved is ensured by means of the gap formed by the protrusion 331 of the resonating part 330 and the protrusion 351 of the design wheel 350, so that if collision occurs on the metal wheel 310, the metal wheel 310 can be moved in up and down directions, thus allowing the vibration of the metal wheel 310 to be sufficiently maintained.

Fifth Embodiment

Figure 16:
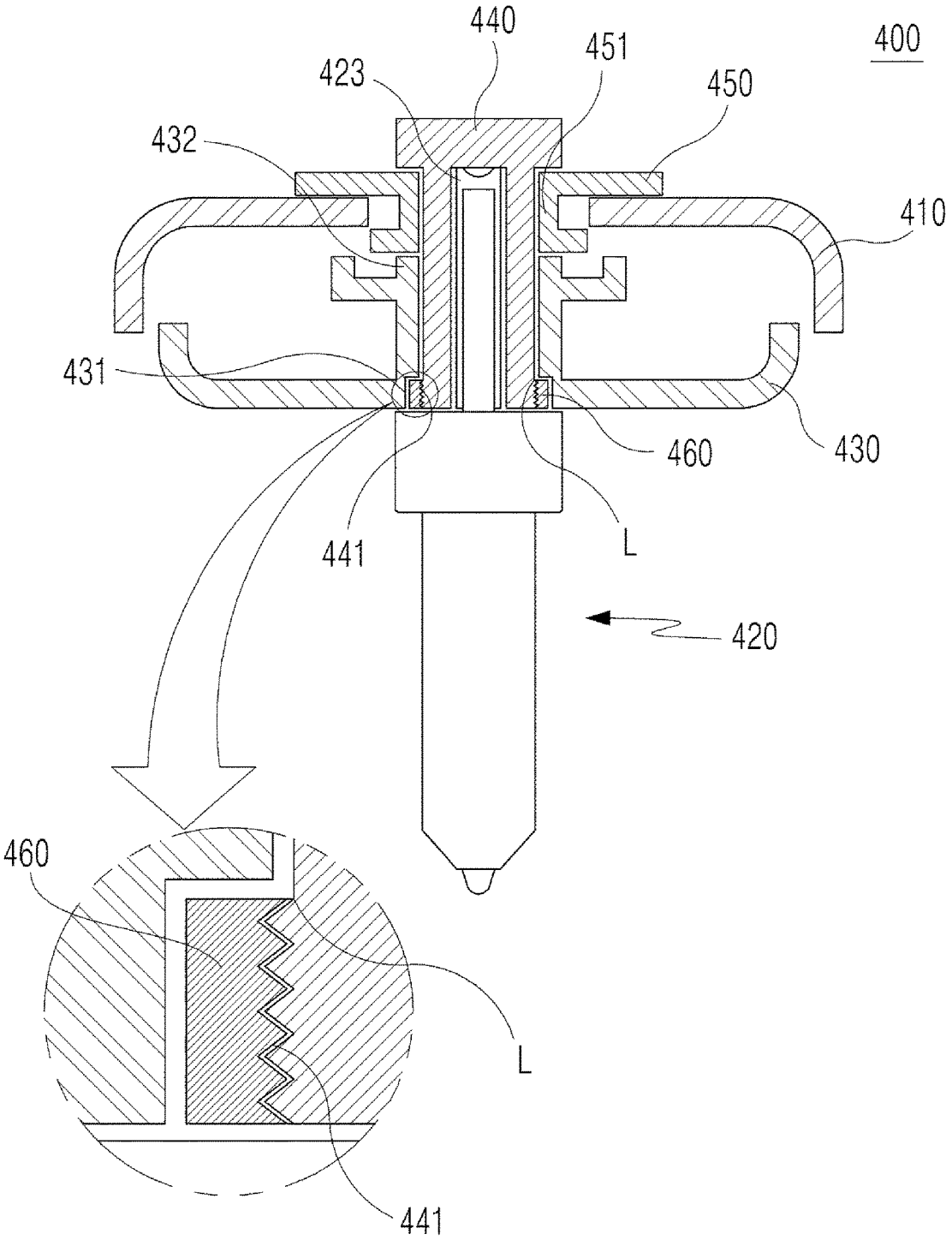
FIG. 16 is a sectional view showing a top according to a fifth embodiment of the present invention.

FIG. 16 is a sectional view showing a top according to a fifth embodiment of the present invention.

As shown in FIG. 16, a top 400 according to the fifth embodiment of the present invention includes a metal wheel 410 having a through hole formed at the center thereof, a rotary force generating part 420 disposed under the metal wheel 410 to support and rotate the metal wheel 410, a fixing part 440 passed through the metal wheel 410 and coupled to the rotary force generating part 420 to allow the metal wheel 410 to be supported by a resonating part 430 and a design wheel 450, the design wheel 450 disposed on the top portion of the metal wheel 410 to improve the outer appearance of the top 400, and a nut 460.

The metal wheel 410 is a metal member having a shape of a disc or a bell which is open on the lower portion thereof and curved at the inside thereof, and the metal wheel 210 includes a through hole formed at the center thereof and at least one or more fastening portions formed concaved radially on the inner periphery of the through hole in such a manner as to be symmetrically located around the through hole.

The rotary force generating part 420 is disposed under the metal wheel 410 and coupled to the metal wheel 410, the resonating part 430 and the design wheel 450 by means of the fixing part 440, thus supporting the metal wheel 410, the resonating part 430 and the design wheel 450 thereagainst.

The resonating part 430 is disposed between the metal wheel 410 and the rotary force generating part 420 to allow the collision sound generated from the metal wheel 410 when the top 400 collides to be resonated and outputted. The resonating part 430 has a shape of a cup which is open on the top surface thereof and has a through hole formed at the center thereof, into which the rotary force generating part 420 is inserted, and a nut accommodating groove 431 formed on the inner periphery of the through hole thereof, into which the nut 460 is accommodated.

Further, the resonating part 430 has a cup-shaped body which is open on the top portion thereof and has a through hole formed at the center thereof and a protrusion 432 protruding upward by a given length from the through hole thereof to maintain a given distance from the design wheel 450.

The fixing part 440 is passed through the design wheel 450, the metal wheel 410 and the resonating part 430 sequentially and coupled to the rotary force generating part 420. The fixing part 440 is screw-coupled to the nut 460 to allow the metal wheel 410 to be movable between the resonating part 430 and the design wheel 450. The fixing part 440 has a cylindrical body having a disc-shaped or polygonal flange formed on one side thereof and a coupling groove formed on the other side thereof to insert a bush 423 of the rotary force generating part 420 thereinto. Further, the fixing part 440 has a screw thread 441 formed on a portion L of the lower outer peripheral surface of the body thereof in such a manner as to be engaged with the nut 460.

The screw thread 441 is formed only on the portion L of the lower end periphery of the fixing part 440 to allow the coupling between the resonating part 430 and the design wheel 450 through the movement of the nut 460 to be restricted, thus preventing the metal wheel 410 from being brought into close contact with the resonating part 430 and the design wheel 450 to permit the metal wheel 410 to be movable when the metal wheel 410 collides.

The design wheel 450 is disposed on the top portion of the metal wheel 410 to improve the outer appearance of the top 400 and has a through hole formed on the center thereof and a protrusion 451 protruding downward by a given length from the through hole thereof, so that even if the protrusion 451 comes into close contact with the resonating part 430, the resonating part 430 and the design wheel 450 are spaced apart from each other.

The nut 460 is engaged with the screw thread 441 formed on the lower end portion of the fixing part 440 to allow the metal wheel 410, the resonating part 430 and the design wheel 450 to be located eccentrically on the fixing part 440.

Accordingly, the coupling between the screw thread 441 formed on the lower end portion of the fixing part 440 and the nut 460 prevents the metal wheel 410 from being brought into close contact with the resonating part 430 and the design wheel 450, so that if collision occurs on the metal wheel 410, the metal wheel 410 can be moved in up and down directions, thus allowing the vibration of the metal wheel 410 to be sufficiently maintained.

Sixth Embodiment

Figure 17:
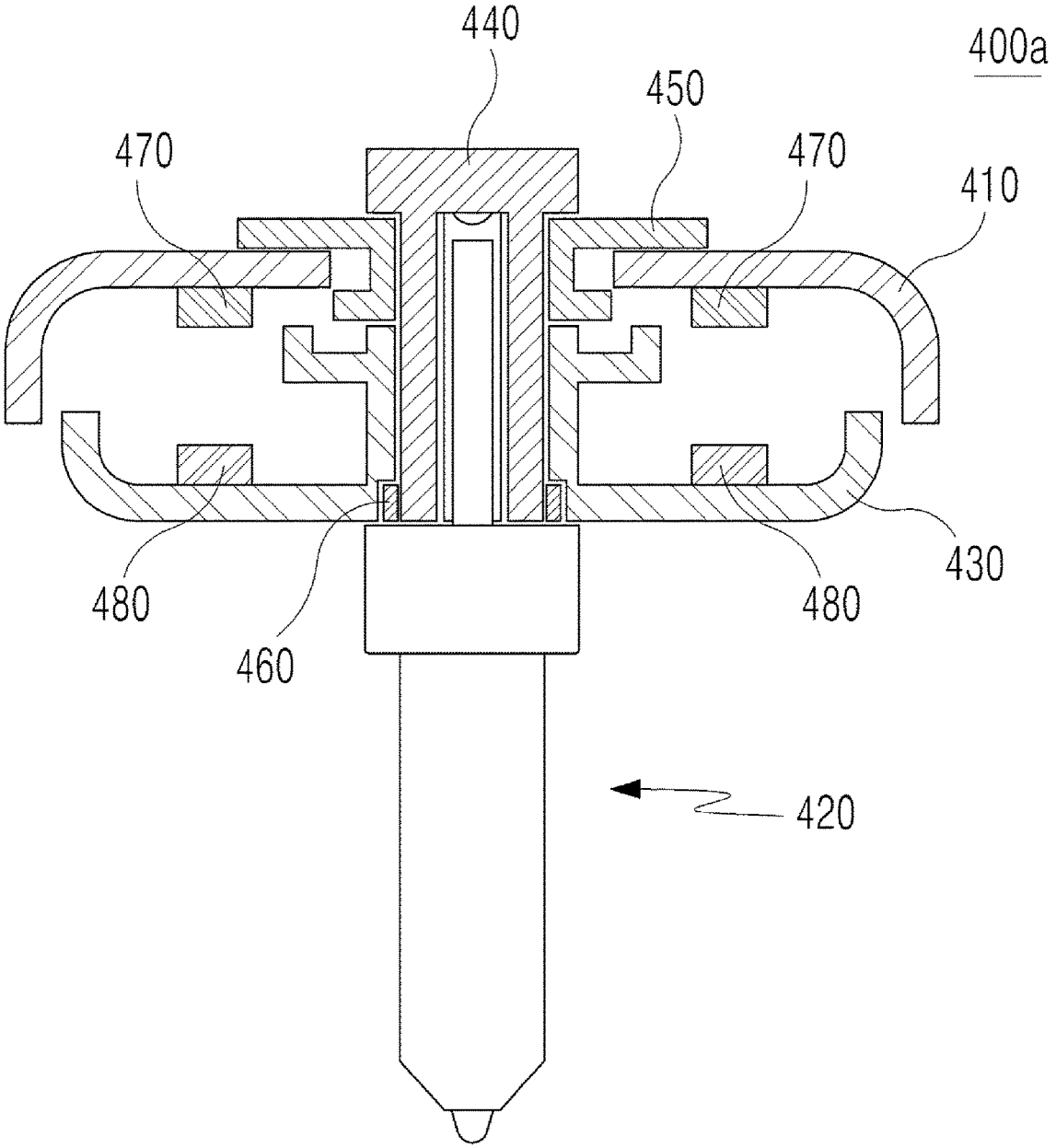
FIG. 17 is a sectional view showing a top according to a sixth embodiment of the present invention.

FIG. 17 is a sectional view showing a top according to a sixth embodiment of the present invention.

As shown in FIG. 17, a top 400*a* according to the sixth embodiment of the present invention includes a metal wheel 410 having a through hole formed at the center thereof, a rotary force generating part 420 disposed under the metal wheel 410 to support and rotate the metal wheel 410, a fixing part 440 passed through the metal wheel 410 and coupled to the rotary force generating part 420 to allow the metal wheel 410 to be supported by a resonating part 430 and a design wheel 350, the design wheel 350 disposed on the top portion of the metal wheel 410 to improve the outer appearance of the top 400*a*, a nut 460, first magnets 470 and second magnets 480.

Under the configuration of the top 400*a* according to the sixth embodiment of the present invention, an explanation on the same components as those in the top 400 according to the fifth embodiment of the present invention will be avoided, and different components from those in the top 400 will be described.

At least one or more first magnets 470 are disposed on the inner surface of the metal wheel 410 and generate repulsive forces from the second magnets 480 to allow the metal wheel 410 to be movable.

Further, at least one or more second magnets 480 are disposed on the inner surface of the resonating part 430 to face the first magnets 470 and generate repulsive forces of the magnetic field to allow the metal wheel 410 to be movable.

That is, the repulsive forces between the metal wheel 410 and the resonating part 430 are generated to prevent the metal wheel 410 disposed movably from being surface-contacted with the resonating part 430 by means of the self weight of the metal wheel 410.

Accordingly, the coupling between the screw thread 441 formed on the lower end portion of the fixing part 440 and the nut 460 prevents the metal wheel 410 from being brought into close contact with the resonating part 430 and the design wheel 450, and if collision occurs on the metal wheel 410, further, the repulsive forces of the first magnets 470 and the second magnets 480 prevent the metal wheel 410 from being surface-contacted with the resonating part 430, thus allowing the vibration of the metal wheel 410 to be sufficiently maintained.

Seventh Embodiment

Figure 18:
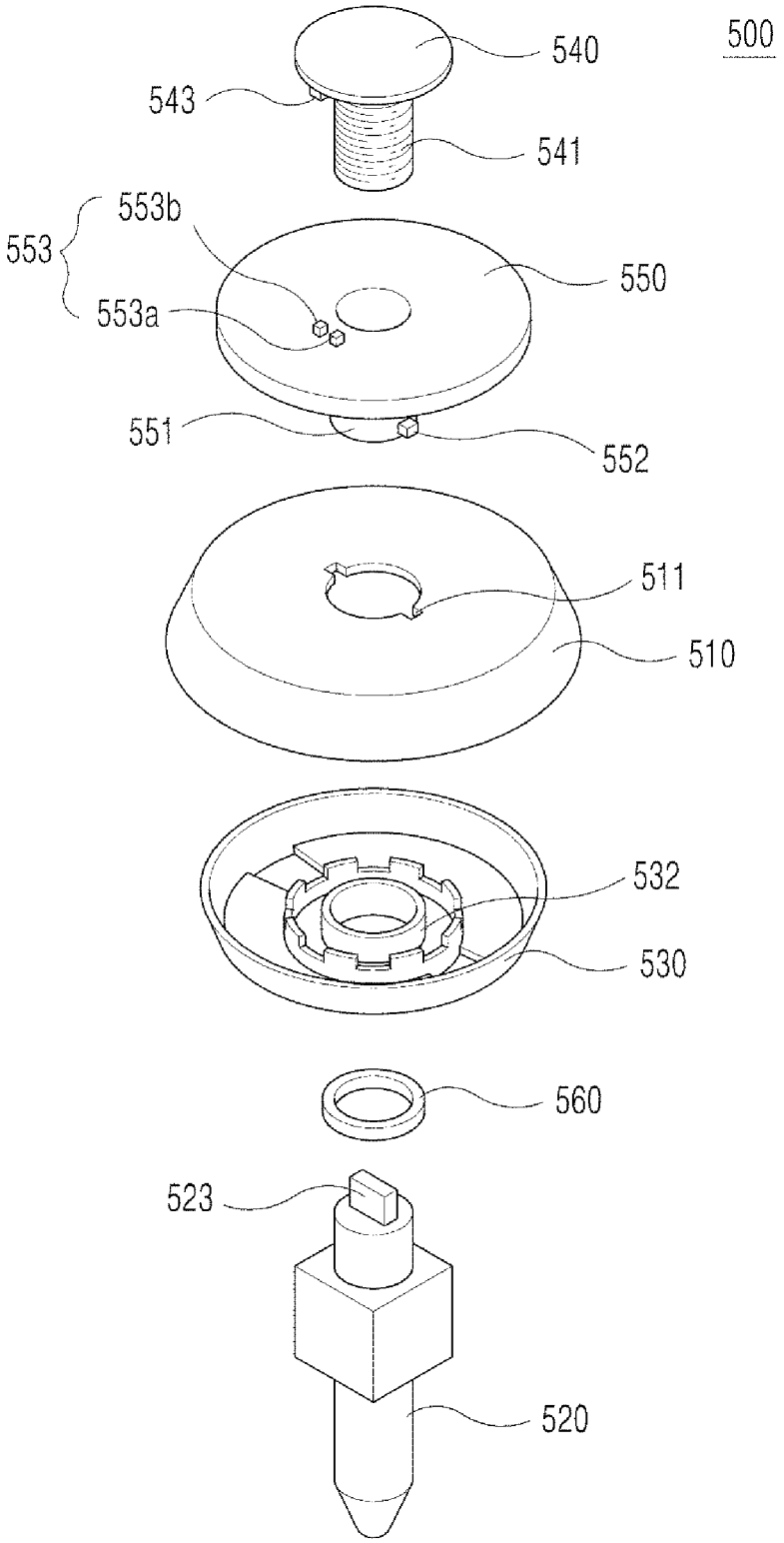
FIG. 18 is an exploded perspective view showing a top according to a seventh embodiment of the present invention.
Figure 19:
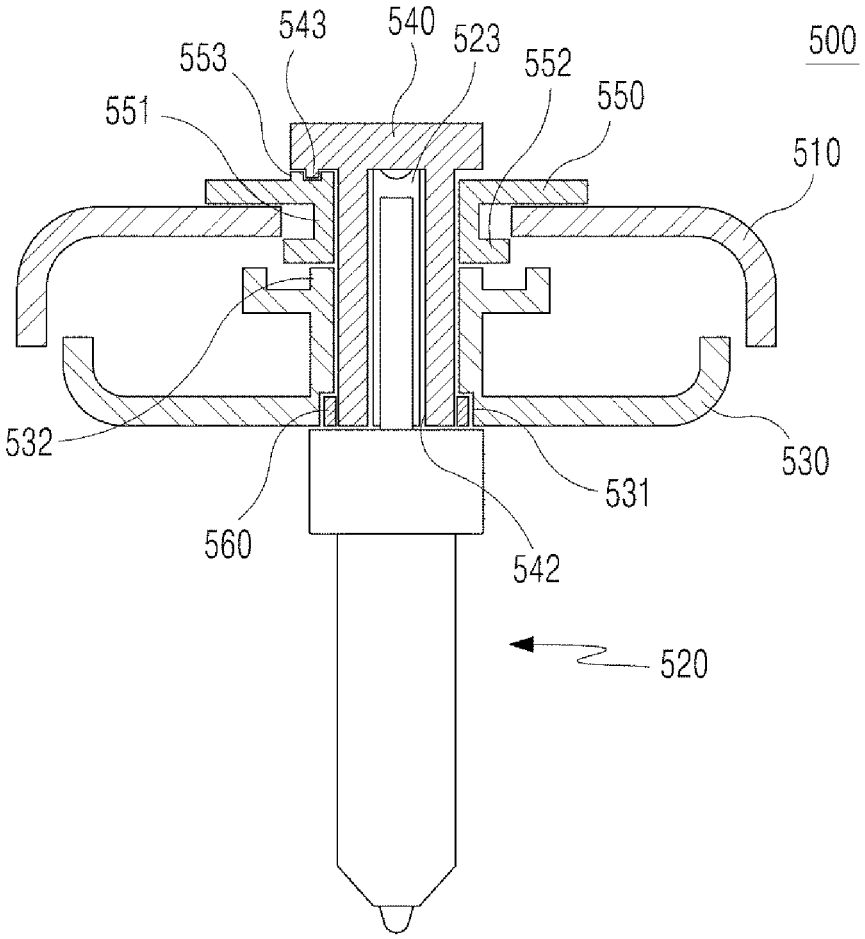
FIG. 19 is a sectional view showing the structure of the toy of FIG. 18.

FIG. 18 is an exploded perspective view showing a top according to a seventh embodiment of the present invention, and FIG. 19 is a sectional view showing the structure of the toy of FIG. 18.

As shown in FIGS. 18 and 19, a top 500 according to the seventh embodiment of the present invention includes a metal wheel 510 having a through hole formed at the center thereof, a rotary force generating part 520 disposed under the metal wheel 510 to support and rotate the metal wheel 510, a fixing part 540 passed through the metal wheel 510 and coupled to the rotary force generating part 520 to allow the metal wheel 510 to be supported by a resonating part 530 and a design wheel 550, the design wheel 550 disposed on the metal wheel 510 to improve the outer appearance of the top 500, and a nut 560.

The metal wheel 510 is a metal member having a shape of a disc or a bell which is open on the lower portion thereof and curved at the inside thereof, and the metal wheel 210 includes a through hole formed at the center thereof and at least one or more fastening portions 511 formed concaved radially on the inner periphery of the through hole in such a manner as to be symmetrically located around the through hole.

The rotary force generating part 520 is disposed under the metal wheel 510 and coupled to the metal wheel 510, the resonating part 530 and the design wheel 550 by means of the fixing part 540, thus supporting the metal wheel 510, the resonating part 530 and the design wheel 550 thereagainst.

The resonating part 530 is disposed between the metal wheel 510 and the rotary force generating part 520 to allow the collision sound generated from the metal wheel 510 when the top 500 collides to be resonated and outputted. The resonating part 530 has a shape of a cup which is open on the top surface thereof and has a through hole formed at the center thereof, into which the rotary force generating part 520 is inserted, and a nut accommodating groove 531 formed on the lower end periphery of the through hole thereof, into which the nut 560 is accommodated.

Further, the resonating part 530 has a cup-shaped body which is open on the top portion thereof and has a through hole formed at the center thereof and a protrusion 532 protruding upward by a given length from the through hole thereof to maintain a given distance from the design wheel 550.

The fixing part 540 is passed through the design wheel 550, the metal wheel 510 and the resonating part 530 sequentially and coupled to the rotary force generating part 520. Next, the fixing part 540 is screw-coupled to the nut 560 to allow the metal wheel 510 to be movable between the resonating part 530 and the design wheel 550. The fixing part 540 has a cylindrical body 541 having a screw thread formed on the outer peripheral surface thereof, and the cylindrical body 541 has a disc-shaped or polygonal flange formed on one side thereof and a coupling groove 542 formed on the other side thereof to insert a bush 523 of the rotary force generating part 520 thereinto. Further, the fixing part 440 has at least one more stoppers 543 formed on the underside of the flange thereof.

The stoppers 543 are engaged with stoppers 553 of the design wheel 550 to prevent the fixing part 540 from rotating over a given range, and further, the fixing part 540 is coupled to the nut 560 to prevent the metal wheel 510, the resonating part 530 and the design wheel 550 from being completely brought into close contact with each other.

That is, the stoppers 543 serve to restrict the coupling position between the fixing part 540 and the nut 560 to maintain somewhat loose coupling state among the metal wheel 510, the resonating part 530 and the design wheel 550.

According to the present invention, one stopper 543 is formed, but two or more stoppers 543 may be formed.

The design wheel 550 is disposed on the top portion of the metal wheel 510 to improve the outer appearance of the top 500 and has an insertion portion 551 protruding downward by a given length from the through hole punched on the center thereof to maintain a given distance between the resonating part 530 and the design wheel 550 even if the insertion portion 551 comes into close contact with the resonating part 530, fastening protrusions 252 protruding outward by a given length radially from the outer peripheral surface of the insertion portion 551 in such a manner as to be engaged with the fastening portions 511 of the metal wheel 510, and the stoppers 553 formed on the top surface thereof in such a manner as to be engaged with the stopper 543 of the fixing part 540.

The stoppers 553 of the design wheel 550 are engaged with the stopper 543 of the fixing part 540 to prevent the fixing part 540 from rotating over a given range and are formed of a pair of first and second stoppers 553*a* and 553*b*.

The first stopper 553*a* protrudes upward by a given length from the top surface of the design wheel 550 in such a manner as to be engaged with the stopper 543 of the fixing part 540 to prevent the fixing part 540 from rotating over a given range.

The second stopper 553*b* is spaced apart from the first stopper 553*a* and protrudes upward by a given length from the top surface of the design wheel 550 to prevent the stopper 543 of the fixing part 540 engaged with the first stopper 553*a* from being rotated in the opposite direction to the rotating direction of the fixing part 540, thus keeping the fixing part 540 from being loose.

That is, the rotation in the opposite direction to the rotating direction of the fixing part 540 engaged with the first stopper 553*a* is prevented by means of the second stopper 553*b*, so that the fixing part 540 does not rotate anymore, and thus, the metal wheel 110 is not completely fixed to the design wheel 111*a* and the resonating part 140*b*, thus forming the gap therebetween.

According to the present invention, one pair of stoppers 553 having the first and second stoppers 553*a* and 553*b* is formed, but of course, a plurality of pairs of stoppers may be formed.

The nut 560 is engaged with the screw thread formed on the outer peripheral surface of the fixing part 540 to allow the metal wheel 510, the resonating part 530 and the design wheel 550 to be located eccentrically around the fixing part 540.

Accordingly, the coupling position between the fixing part 540 and the nut 560 is restricted by means of the stopper 543 of the fixing part 540 and the stoppers 553 of the design wheel 550 to maintain somewhat loose coupling state among the metal wheel 510, the resonating part 530 and the design wheel 550, so that if collision occurs on the metal wheel 510, the metal wheel 510 can be moved in up and down directions, thus allowing the vibration of the metal wheel 510 to be sufficiently maintained.

Eighth Embodiment

Figure 20:
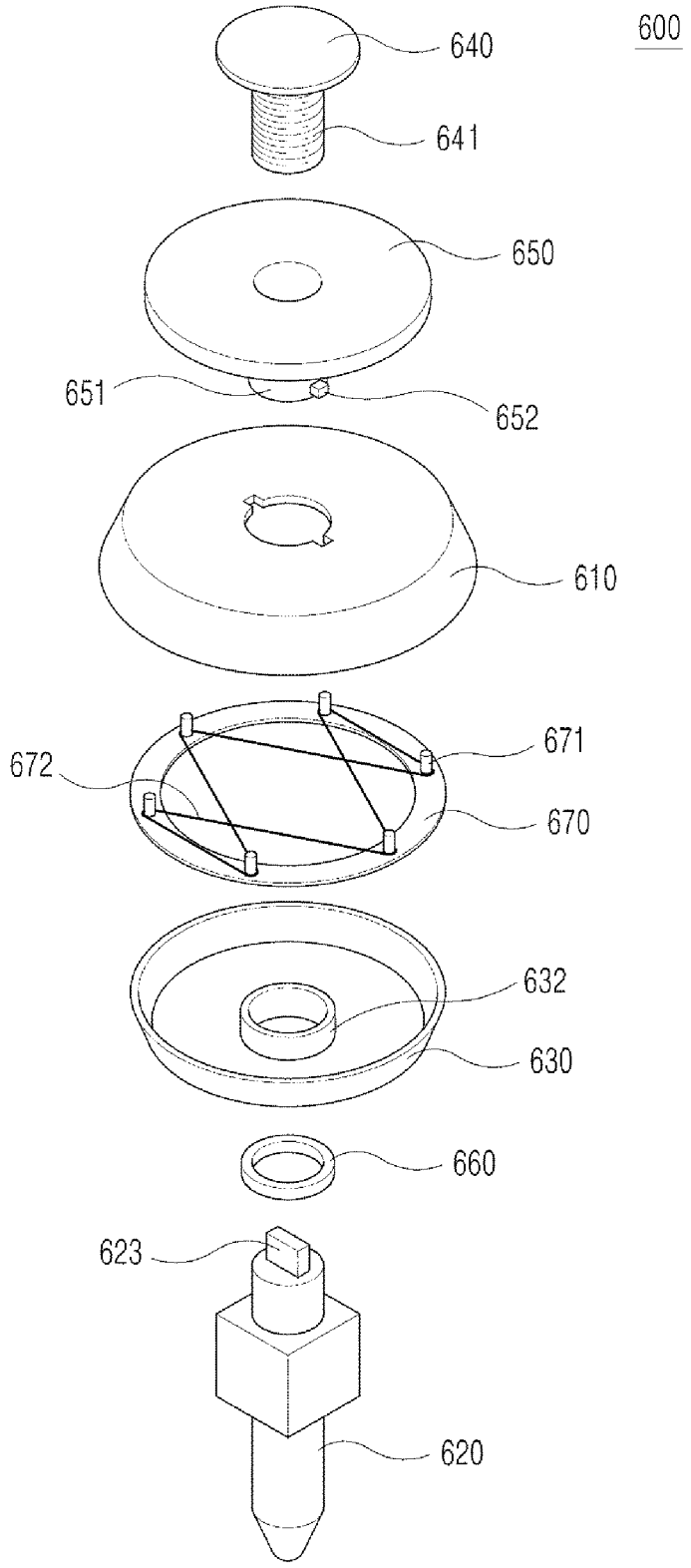
FIG. 20 is an exploded perspective view showing a top according to an eighth embodiment of the present invention.
Figure 21:
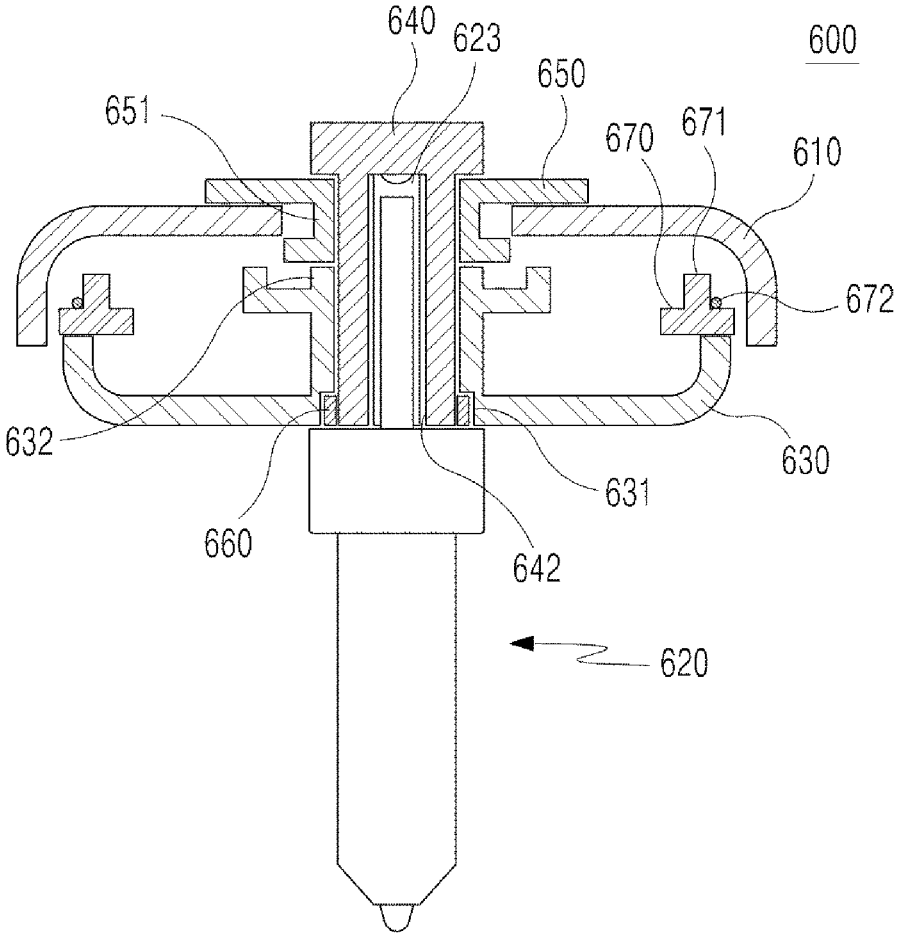
FIG. 21 is a sectional view showing the structure of the toy of FIG. 20.

FIG. 20 is an exploded perspective view showing a top according to an eighth embodiment of the present invention, and FIG. 21 is a sectional view showing the structure of the toy of FIG. 20.

As shown in FIGS. 20 and 21, a top 600 according to the eighth embodiment of the present invention includes a metal wheel 610 having a through hole formed at the center thereof, a rotary force generating part 620 disposed under the metal wheel 610 to support and rotate the metal wheel 610, a fixing part 640 passed through the metal wheel 610 and coupled to the rotary force generating part 620 to allow the metal wheel 610 to be supported by a resonating part 630 and a design wheel 650, the design wheel 650 disposed on the top portion of the metal wheel 610 to improve the outer appearance of the top 600, a nut 660 coupled to the fixing part 640, and a vibration amplifying part 670.

The metal wheel 610 is a metal member having a shape of a disc or a bell which is open on the lower portion thereof and curved at the inside thereof, and the metal wheel 210 includes a through hole formed at the center thereof and at least one or more fastening portions formed concaved radially on the inner periphery of the through hole in such a manner as to be symmetrically located around the through hole.

The rotary force generating part 620 is disposed under the metal wheel 610 and coupled to the metal wheel 610, the resonating part 630 and the design wheel 650 by means of the fixing part 640, thus supporting the metal wheel 610, the resonating part 630 and the design wheel 650 thereagainst.

The resonating part 630 is disposed between the metal wheel 610 and the rotary force generating part 620 to allow the collision sound generated from the metal wheel 610 when the top 600 collides to be resonated and outputted. The resonating part 630 has a shape of a cup which is open on the top surface thereof and has a through hole formed at the center thereof, into which the rotary force generating part 620 is inserted, and a nut accommodating groove 631 formed on the lower end periphery of the through hole thereof, into which the nut 660 is accommodated.

Further, the resonating part 630 has a cup-shaped body which is open on the top portion thereof and has a through hole formed at the center thereof and a protrusion 632 protruding upward by a given length from the through hole thereof to maintain a given distance from the design wheel 650.

The fixing part 640 is passed through the design wheel 650, the metal wheel 610 and the resonating part 630 sequentially and coupled to the rotary force generating part 620. Next, the fixing part 640 is screw-coupled to the nut 660 to allow the metal wheel 610 to be movable between the resonating part 630 and the design wheel 650. The fixing part 640 has a cylindrical body 641 having a screw thread formed on the outer peripheral surface thereof, and the cylindrical body 641 has a disc-shaped or polygonal flange formed on one side thereof and a coupling groove 642 formed on the other side thereof to insert a bush 623 of the rotary force generating part 620 thereinto.

The design wheel 650 is disposed on the top portion of the metal wheel 610 to improve the outer appearance of the top 600 and has an insertion portion 651 protruding downward by a given length from the through hole punched on the center thereof to maintain a given distance between the resonating part 630 and the design wheel 650 even if the insertion portion 651 comes into close contact with the resonating part 630, and fastening protrusions 652 protruding outward by a given length radially from the outer peripheral surface of the insertion portion 651 in such a manner as to be engaged with the fastening portions of the metal wheel 610.

The nut 660 is engaged with the screw thread formed on the outer peripheral surface of the fixing part 640 to allow the metal wheel 610, the resonating part 630 and the design wheel 650 to be located eccentrically around the fixing part 640.

The vibration amplifying part 670 is disposed between the metal wheel 610 and the resonating part 630 to allow the metal wheel 610 and the resonating part 630 to be spaced apart from each other by a given distance and vibrates in response to the vibration generated from the metal wheel 610 upon the collision to increase the resonance of the collision sound. The vibration amplifying part 670 includes a plurality of supporters 671 and a string 672.

The supporters 671 protrude from a ring-shaped body of the vibration amplifying part 670 to support the string 672 thereagainst.

The string 672 is supportedly disposed by the supporters 671 and vibrates in response to the vibration of the collision sound, thus allowing the vibration of the collision sound to be maintained for a long period of time between the metal wheel 610 and the resonating part 630.

Accordingly, the formation of the vibration amplifying part 670 prevents the metal wheel 610 and the resonating part 630 from coming into close contact with each other, and the vibration of the metal wheel 610 is transmitted to the string 672 of the vibration amplifying part 670 by means of wind to cause the string 672 to vibrate, so that if collision occurs on the metal wheel 610, the metal wheel 610 can be moved in up and down directions and at the same time the vibration of the metal wheel 610 is maintained through the string 672, thus allowing the vibration of the metal wheel 610 to be sufficiently maintained.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

While the present invention with reference to the accompanying drawings is described with reference to the particular illustrative embodiments, further, the component's width, length, thickness, etc. are exaggerated for the clearness and convenience of the description. The above-mentioned terms are defined in consideration of the functions in the present invention, which may be varied in accordance with a user or operator's intention or practice, and accordingly, the definitions of the terms should be based on the contents of the specification.

The invention claimed is:

1. A top comprising:

a metal wheel;

a rotary force generating part configured to generate a rotary force to rotate the metal wheel;

a fixing part fixing the metal wheel to the rotary force generating part;

a bush disposed inside the fixing part;

a shaft disposed inside the metal wheel; and a resonating part installed at a lower part of the metal wheel to be fixed on the fixing part and having an outer diameter that is smaller than the inner diameter of the metal wheel, wherein the bush is configured to prevent the shaft from idling, in response to the shaft being coupled to the fixing part.

2. The top according to claim 1, further comprising a winder with a handle and an elongated rack gear, wherein the elongated gear is configured to engage with a pinion gear of the rotary force generating part.

* * * * *